US006727874B2

(12) United States Patent
Okuzono

(10) Patent No.: US 6,727,874 B2
(45) Date of Patent: Apr. 27, 2004

(54) DRIVING CIRCUIT AND DRIVING METHOD OF COLOR LIQUID CRYSTAL DISPLAY, AND COLOR LIQUID CRYSTAL DISPLAY DEVICE

(75) Inventor: Noboru Okuzono, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 249 days.

(21) Appl. No.: 09/988,189

(22) Filed: Nov. 19, 2001

(65) Prior Publication Data

US 2002/0060656 A1 May 23, 2002

(30) Foreign Application Priority Data

Nov. 20, 2000 (JP) ..... 2000-353427

(51) Int. Cl.[7] ..... G09G 3/36

(52) U.S. Cl. ..... 345/89; 345/89; 345/690; 349/34

(58) Field of Search ..... 345/88, 89, 98, 345/690, 208, 210, 211, 100; 349/34

(56) References Cited

U.S. PATENT DOCUMENTS 5,245,326 A * 9/1993 Zalph ..... 345/92
6,275,207 B1 8/2001 Nitta et al.
6,414,664 B1 * 7/2002 Conover et al. ..... 345/89
6,462,735 B2 * 10/2002 Naito ..... 345/204
6,483,496 B2 * 11/2002 Kobayashi et al. ..... 345/98
6,549,182 B2 4/2003 Nitta et al.
2002/0003521 A1 * 1/2002 Matsueda et al. ..... 345/89
2002/0027551 A1 3/2002 Nitta et al.

FOREIGN PATENT DOCUMENTS

JP 6-138849 A 5/1994
JP 6-202578 A 7/1994
JP 10-26939 A 1/1998
JP 11-175027 A 7/1999

* cited by examiner

*Primary Examiner*—Amr Awad
(74) *Attorney, Agent, or Firm*—Foley & Lardner

(57) ABSTRACT

A driving circuit of a color liquid crystal display is provided which is capable of reducing a substrate packaging area and using a common substrate or TCP (Tape Carrier Package) even when a resolution and/or the number of gray scale voltages that the color liquid crystal display provides are different, which enables the substrate, TCP, and a display device to be fabricated at low costs. In the driving circuit of the color liquid crystal display, a data electrode driving circuit produces gray scale voltages corresponding to gray scale voltage characteristics based on serial data made up of gray scale information and gray scale voltage information.

12 Claims, 17 Drawing Sheets

FIG.2

| gray scale information | | | | | | channel |
|---|---|---|---|---|---|---|
| A5 | A4 | A3 | A2 | A1 | A0 | |
| 0 | 0 | 0 | 0 | 0 | 0 | Ch R0 |
| 0 | 0 | 0 | 0 | 0 | 1 | Ch R1 |
| 0 | 0 | 0 | 0 | 1 | 0 | Ch R2 |
| 0 | 0 | 0 | 0 | 1 | 1 | Ch R3 |
| 0 | 0 | 0 | 1 | 0 | 0 | Ch R4 |
| 0 | 0 | 0 | 1 | 0 | 1 | Ch R5 |
| 0 | 0 | 0 | 1 | 1 | 0 | Ch R6 |
| 0 | 0 | 0 | 1 | 1 | 1 | Ch R7 |
| 0 | 0 | 1 | 0 | 0 | 0 | Ch R8 |
| 0 | 0 | 1 | 0 | 0 | 1 | Ch R9 |
| 0 | 0 | 1 | 0 | 1 | 0 | Ch R10 |
| 0 | 0 | 1 | 0 | 1 | 1 | Ch R11 |
| 0 | 0 | 1 | 1 | 0 | 0 | Ch R12 |
| 0 | 0 | 1 | 1 | 0 | 1 | Ch R13 |
| 0 | 0 | 1 | 1 | 1 | 0 | Ch R14 |
| 0 | 0 | 1 | 1 | 1 | 1 | Ch R15 |
| 0 | 1 | 0 | 0 | 0 | 0 | Ch R16 |
| 0 | 1 | 0 | 0 | 0 | 1 | Ch R17 |
| 0 | 1 | 0 | 0 | 1 | 0 | Ch G0 |
| 0 | 1 | 0 | 0 | 1 | 1 | Ch G1 |
| 0 | 1 | 0 | 1 | 0 | 0 | Ch G2 |
| 0 | 1 | 0 | 1 | 0 | 1 | Ch G3 |
| 0 | 1 | 0 | 1 | 1 | 0 | Ch G4 |
| 0 | 1 | 0 | 1 | 1 | 1 | Ch G5 |
| 0 | 1 | 1 | 0 | 0 | 0 | Ch G6 |
| 0 | 1 | 1 | 0 | 0 | 1 | Ch G7 |
| 0 | 1 | 1 | 0 | 1 | 0 | Ch G8 |
| 0 | 1 | 1 | 0 | 1 | 1 | Ch G9 |
| 0 | 1 | 1 | 0 | 0 | 0 | Ch G10 |
| 0 | 1 | 1 | 1 | 0 | 1 | Ch G11 |
| 0 | 1 | 1 | 1 | 1 | 0 | Ch G12 |
| 0 | 1 | 1 | 1 | 1 | 1 | Ch G13 |
| 0 | 1 | 1 | 1 | 0 | 0 | Ch G14 |
| 1 | 0 | 0 | 0 | 0 | 1 | Ch G15 |
| 1 | 0 | 0 | 0 | 1 | 0 | Ch G16 |
| 1 | 0 | 0 | 0 | 1 | 1 | Ch G17 |
| 1 | 0 | 0 | 1 | 0 | 0 | Ch B0 |
| 1 | 0 | 0 | 1 | 0 | 1 | Ch B1 |
| 1 | 0 | 0 | 1 | 1 | 0 | Ch B2 |
| 1 | 0 | 0 | 1 | 1 | 1 | Ch B3 |
| 1 | 0 | 1 | 0 | 0 | 0 | Ch B4 |
| 1 | 0 | 1 | 0 | 0 | 1 | Ch B5 |
| 1 | 0 | 1 | 0 | 1 | 0 | Ch B6 |
| 1 | 0 | 1 | 0 | 1 | 1 | Ch B7 |
| 1 | 0 | 1 | 1 | 0 | 0 | Ch B8 |
| 1 | 0 | 1 | 1 | 0 | 1 | Ch B9 |
| 1 | 0 | 1 | 1 | 1 | 0 | Ch B10 |
| 1 | 0 | 1 | 1 | 1 | 1 | Ch B11 |
| 1 | 1 | 0 | 0 | 0 | 0 | Ch B12 |
| 1 | 1 | 0 | 0 | 0 | 1 | Ch B13 |
| 1 | 1 | 0 | 1 | 1 | 0 | Ch B14 |
| 1 | 1 | 0 | 1 | 1 | 1 | Ch B15 |
| 1 | 1 | 0 | 1 | 0 | 0 | Ch B16 |
| 1 | 1 | 0 | 1 | 0 | 1 | Ch B17 |

*FIG.3*

| gray scale voltage information | | | | | | | | gray scale voltage |
|---|---|---|---|---|---|---|---|---|
| D7 | D6 | D5 | D4 | D3 | D2 | D1 | D0 | |
| 0 | 0 | 0 | 0 | 0 | 0 | 0 | 0 | $V_0$ |
| 0 | 0 | 0 | 0 | 0 | 0 | 0 | 1 | $V_1$ |
| 0 | 0 | 0 | 0 | 0 | 0 | 1 | 0 | $V_2$ |
| 0 | 0 | 0 | 0 | 0 | 0 | 1 | 1 | $V_3$ |
| 0 | 0 | 0 | 0 | 0 | 1 | 0 | 0 | $V_4$ |
| 0 | 0 | 0 | 0 | 0 | 1 | 0 | 1 | $V_5$ |
| 0 | 0 | 0 | 0 | 0 | 1 | 1 | 0 | $V_6$ |
| 0 | 0 | 0 | 0 | 0 | 1 | 1 | 1 | $V_7$ |
| 0 | 0 | 0 | 0 | 1 | 0 | 0 | 0 | $V_8$ |
| 0 | 0 | 0 | 0 | 1 | 0 | 0 | 1 | $V_9$ |
| 0 | 0 | 0 | 0 | 1 | 0 | 1 | 0 | $V_{10}$ |
| 0 | 0 | 0 | 0 | 1 | 0 | 1 | 1 | $V_{11}$ |
| 0 | 0 | 0 | 0 | 1 | 1 | 0 | 0 | $V_{12}$ |
| ⋮ | ⋮ | ⋮ | ⋮ | ⋮ | ⋮ | ⋮ | ⋮ | ⋮ |
| 1 | 1 | 1 | 1 | 0 | 0 | 1 | 1 | $V_{243}$ |
| 1 | 1 | 1 | 1 | 0 | 1 | 0 | 0 | $V_{244}$ |
| 1 | 1 | 1 | 1 | 0 | 1 | 0 | 1 | $V_{245}$ |
| 1 | 1 | 1 | 1 | 0 | 1 | 1 | 0 | $V_{246}$ |
| 1 | 1 | 1 | 1 | 0 | 1 | 1 | 1 | $V_{247}$ |
| 1 | 1 | 1 | 1 | 1 | 0 | 0 | 0 | $V_{248}$ |
| 1 | 1 | 1 | 1 | 1 | 0 | 0 | 1 | $V_{249}$ |
| 1 | 1 | 1 | 1 | 1 | 0 | 1 | 0 | $V_{250}$ |
| 1 | 1 | 1 | 1 | 1 | 0 | 1 | 1 | $V_{251}$ |
| 1 | 1 | 1 | 1 | 1 | 1 | 0 | 0 | $V_{252}$ |
| 1 | 1 | 1 | 1 | 1 | 1 | 0 | 1 | $V_{253}$ |
| 1 | 1 | 1 | 1 | 1 | 1 | 1 | 0 | $V_{254}$ |
| 1 | 1 | 1 | 1 | 1 | 1 | 1 | 1 | $V_{255}$ |

FIG. 11A

| red gray scale voltage information | | | | | | | | gray scale voltage |
|---|---|---|---|---|---|---|---|---|
| $D_{R7}$ | $D_{R6}$ | $D_{R5}$ | $D_{R4}$ | $D_{R3}$ | $D_{R2}$ | $D_{R1}$ | $D_{R0}$ | |
| 0 | 0 | 0 | 0 | 0 | 0 | 0 | 0 | $V_0$ |
| 0 | 0 | 0 | 0 | 0 | 0 | 0 | 1 | $V_1$ |
| 0 | 0 | 0 | 0 | 0 | 0 | 1 | 0 | $V_2$ |
| 0 | 0 | 0 | 0 | 0 | 0 | 1 | 1 | $V_3$ |
| 0 | 0 | 0 | 0 | 0 | 1 | 0 | 0 | $V_4$ |
| ⋮ | ⋮ | ⋮ | ⋮ | ⋮ | ⋮ | ⋮ | ⋮ | ⋮ |
| 1 | 1 | 1 | 1 | 1 | 1 | 0 | 0 | $V_{252}$ |
| 1 | 1 | 1 | 1 | 1 | 1 | 0 | 1 | $V_{253}$ |
| 1 | 1 | 1 | 1 | 1 | 1 | 1 | 0 | $V_{254}$ |
| 1 | 1 | 1 | 1 | 1 | 1 | 1 | 1 | $V_{255}$ |

FIG. 11B

| green gray scale voltage information | | | | | | | | gray scale voltage |
|---|---|---|---|---|---|---|---|---|
| $D_{G7}$ | $D_{G6}$ | $D_{G5}$ | $D_{G4}$ | $D_{G3}$ | $D_{G2}$ | $D_{G1}$ | $D_{G0}$ | |
| 0 | 0 | 0 | 0 | 0 | 0 | 0 | 0 | $V_0$ |
| 0 | 0 | 0 | 0 | 0 | 0 | 0 | 1 | $V_1$ |
| 0 | 0 | 0 | 0 | 0 | 0 | 1 | 0 | $V_2$ |
| 0 | 0 | 0 | 0 | 0 | 0 | 1 | 1 | $V_3$ |
| 0 | 0 | 0 | 0 | 0 | 1 | 0 | 0 | $V_4$ |
| ⋮ | ⋮ | ⋮ | ⋮ | ⋮ | ⋮ | ⋮ | ⋮ | ⋮ |
| 1 | 1 | 1 | 1 | 1 | 1 | 0 | 0 | $V_{252}$ |
| 1 | 1 | 1 | 1 | 1 | 1 | 0 | 1 | $V_{253}$ |
| 1 | 1 | 1 | 1 | 1 | 1 | 1 | 0 | $V_{254}$ |
| 1 | 1 | 1 | 1 | 1 | 1 | 1 | 1 | $V_{255}$ |

FIG. 11C

| blue gray scale voltage information | | | | | | | | gray scale voltage |
|---|---|---|---|---|---|---|---|---|
| $D_{B7}$ | $D_{B6}$ | $D_{B5}$ | $D_{B4}$ | $D_{B3}$ | $D_{B2}$ | $D_{B1}$ | $D_{B0}$ | |
| 0 | 0 | 0 | 0 | 0 | 0 | 0 | 0 | $V_0$ |
| 0 | 0 | 0 | 0 | 0 | 0 | 0 | 1 | $V_1$ |
| 0 | 0 | 0 | 0 | 0 | 0 | 1 | 0 | $V_2$ |
| 0 | 0 | 0 | 0 | 0 | 0 | 1 | 1 | $V_3$ |
| 0 | 0 | 0 | 0 | 0 | 1 | 0 | 0 | $V_4$ |
| ⋮ | ⋮ | ⋮ | ⋮ | ⋮ | ⋮ | ⋮ | ⋮ | ⋮ |
| 1 | 1 | 1 | 1 | 1 | 1 | 0 | 0 | $V_{252}$ |
| 1 | 1 | 1 | 1 | 1 | 1 | 0 | 1 | $V_{253}$ |
| 1 | 1 | 1 | 1 | 1 | 1 | 1 | 0 | $V_{254}$ |
| 1 | 1 | 1 | 1 | 1 | 1 | 1 | 1 | $V_{255}$ |

DRIVING CIRCUIT AND DRIVING METHOD OF COLOR LIQUID CRYSTAL DISPLAY, AND COLOR LIQUID CRYSTAL DISPLAY DEVICE

BACKGROUND OF THE INVENTION

1. Field of the Invention

The present invention relates to a driving circuit and a driving method of a color liquid crystal display, and a color liquid crystal display device; and more particularly to the driving circuit of the color liquid crystal display adapted to drive the color liquid crystal display based on digital video data to which a gamma correction has been made, the display device having such the driving circuit of the color liquid crystal display, and the method for driving the color liquid crystal display.

The present application claims priority of Japanese Patent Application No.2000-353427 filed on Nov. 20, 2000, which is hereby incorporated by reference.

2. Description of the Related Art

FIG. 17 is a schematic block diagram showing an example of configurations of a conventional driving circuit of a color liquid crystal display 1 disclosed in Japanese Laid-open Patent Application No. 2001-134242 published on May 18, 2001 later than the filing date of Japanese Patent Application No. 2000-353427 corresponding to the present application (Therefore, Japanese Laid-open Patent Application No. 2001-134242 has not a qualification as a prior art reference.)

The disclosed color liquid crystal display 1 is of a type of color liquid crystal display that is driven by an active-matrix driving method and that uses, for example, a TFT (Thin Film Transistor) as a switching element. Pixels are disposed in a region surrounded by a plurality of scanning electrodes (gate lines) mounted at predetermined intervals in a row direction and by a plurality of data electrodes (source lines) mounted at predetermined intervals in a column direction. Each of the pixels has a liquid crystal cell being equivalently a capacitive load, the TFT used to drive a corresponding liquid crystal cell and a capacitor used to accumulate a data charge during one vertical sync period. By applying a data red signal, data green signal, and data blue signal to be produced, based on red data $D_R$, green data $D_G$, and blue data $D_B$ being digital video data, to the data electrode and, at the same time, by applying scanning signals to be produced based on a horizontal sync signal and a vertical sync signal to the scanning electrode, a color character, color image or a like is displayed (though not shown in FIG. 17). Moreover, the disclosed color liquid crystal display 1 operates in a so-called "normally black mode" in which transmittance or luminance of light obtained when an off-driving voltage is applied is lower than those obtained when the on-driving voltage is applied.

As shown in FIG. 17, the disclosed driving circuit of the color liquid crystal display 1 chiefly includes a control circuit 2, a gray scale power circuit 3, a data electrode driving circuit 4, and a scanning electrode driving circuit 5.

The control circuit 2 is made up of, for example, ASICs (Application Specific Integrated Circuits) and is adapted to feed 8 bits of red data $D_R$, 8 bits of green data $D_G$, and 8 bits of blue data $D_B$ supplied from an outside to the data electrode driving circuit 4 and, at the same time, to produce a horizontal scanning pulse $P_H$, a vertical scanning pulse $P_V$, and a polarity reversed pulse POL used to drive the color liquid crystal display 1 with alternating current, based on the horizontal sync signal and vertical sync signal, and to feed these pulses to the data electrode driving circuit 4 and the scanning electrode driving circuit 5. Moreover, the control circuit 2 feeds a red gray scale voltage data $D_{GR}$, a green gray scale voltage data $D_{GG}$, and a blue gray scale voltage data $D_{GB}$ obtained by making an individual and separate gamma correction to each of the red data $D_R$, green data $D_G$, and blue data $D_B$ to provide gray scales, to the gray scale power circuit 3. Moreover, the gamma correction employed in the embodiment includes one gamma correction (hereinafter referred to as a first gamma correction) in which the correction is made to arbitrarily provide a characteristic of luminance required in reproduced images to luminance of input images and another gamma correction (hereinafter referred to as a second gamma correction) that is made to match an "applied voltage–transmittance" characteristic (hereinafter as a V–T characteristic) for each of the red, green, and blue colors used in the color liquid crystal display 1.

The gray scale power circuit 3, as shown in FIG. 18, includes digital/analog converters (DACs) $\mathbf{11}_1$ to $\mathbf{11}_3$ and voltage followers $\mathbf{12}_1$ to $\mathbf{12}_{54}$. The DAC $\mathbf{11}_1$ converts the red gray scale data DGR fed from the control circuit 2 into analog red gray scale voltages $V_{R0}$ to $V_{R17}$ and feeds them to the voltage followers $\mathbf{12}_1$ to $\mathbf{12}_{18}$, respectively. Similarly, the DAC $\mathbf{11}_2$ converts the green gray scale data $D_{GG}$ fed from the control circuit 2 into analog green gray scale voltages $V_{G0}$ to $V_{G17}$ and feeds them to the voltage followers $\mathbf{12}_{19}$ to $\mathbf{12}_{36}$, respectively. The DAC $\mathbf{11}_3$ converts the blue gray scale data $D_{GB}$ fed from the control circuit 2 into analog green gray scale voltages $V_{B0}$ to $V_{B17}$ and feeds them to the voltage followers $\mathbf{12}_{37}$ to $\mathbf{12}_{54}$, respectively. The voltage followers $\mathbf{12}_1$ to $\mathbf{12}_{54}$ feed the red gray scale voltages $V_{R0}$ to $V_{R17}$, the corresponding green gray scale voltages $V_{G0}$ to $V_{G17}$, and the blue gray scale voltages $V_{B0}$ to $V_{B17}$, which are all used for making the gamma correction, as they are, to the data electrode driving circuit 4.

The data electrode driving circuit 4 is made up of k pieces ("k" being a natural number) of data electrode driving sections $\mathbf{4}_1$ to $\mathbf{4}_k$. Each of the data electrode driving sections $\mathbf{4}_1$ to $\mathbf{4}_k$ makes the gamma correction, based on red gray scale voltages $V_{R0}$ to $V_{R17}$, green gray scale voltages $V_{G0}$ to $V_{G17}$, and blue gray scale voltages $V_{B0}$ to $V_{B17}$ fed from the gray scale power circuit 3, to the red data $D_R$, green data $D_G$, and blue data $D_B$ each corresponding to each of data electrodes mounted in the color liquid crystal display 1, out of the red data $D_R$, the green data $D_G$, and the blue data $D_B$ fed from the control circuit 2, in order to provide gray scales, and converts the gamma-corrected data into 384 pieces of analog data signals and then outputs them. For example, when the color liquid crystal display 1 is of a type of SXGA (Super Extended Graphics Array) which provides 1280×1024 pixel resolution, since one pixel is made up of three dot pixels including a red (R) dot pixel, a green (G) dot pixel, and a blue (B) dot pixel, the number of dot pixels becomes 3840×1024. Therefore, in the example, the data electrode driving circuit 4 is made up of ten pieces of data electrode driving sections $\mathbf{4}_1$ to $\mathbf{4}_{10}$ (3840 pieces of pixels÷384 pieces of data signals). Since all of the data electrode driving sections $\mathbf{4}_1$ to $\mathbf{4}_{10}$ have the same configurations except that each of their components and each of input and output signals have a different subscript, a description of only the data electrode driving section $\mathbf{4}_1$ will be provided below.

FIG. 19 is a schematic block diagram showing an example of configurations of the data electrode driving section $\mathbf{4}_1$. As shown in FIG. 19, the data electrode driving section $\mathbf{4}_1$ chiefly includes multiplexers (MPXs) $\mathbf{13}_1$ to $\mathbf{13}_3$, DACs $\mathbf{14}_1$ to $14_3$ (of an 8 bit-data conversion type), and voltage followers $15_1$ to $15_{384}$. The MPX $13_1$ switches a set of red gray scale voltages $V_{R0}$ to $V_{R8}$ or a set of red gray scale voltages $V_{R9}$ to $V_{R17}$, out of red gray scale voltages $V_{R0}$ to $V_{R17}$ fed from the gray scale power circuit 3, based on a polarity reversed pulse POL fed from the control circuit 2 and feeds the switched voltages to the DAC $14_1$. Similarly, the MPX $13_2$ switches a set of red gray scale voltages $V_{G0}$ to $V_{G8}$ or a set of green gray scale voltages $V_{G9}$ to $V_{G17}$, out of green gray scale voltages $V_{G0}$ to $V_{G17}$ fed from the gray scale power circuit 3, based on the polarity reversed pulse POL fed from the control circuit 2 and feeds the switched voltages to the DAC $14_2$. The MPX $13_2$ switches a set of red gray scale voltages $V_{B0}$ to $V_{B8}$ or a set of green gray scale voltages $V_{B9}$ to $V_{B17}$, out of green gray scales $V_{B0}$ to $V_{B17}$ fed from the gray scale power circuit 3, based on the polarity reversed pulse POL fed from the control circuit 2 and feeds the switched voltages to the DAC $14_3$.

The DAC $14_1$ makes the gamma correction, based on the set of red gray scale voltages $V_{R0}$ to $V_{R8}$ or the set of the red gray scale voltages $V_{R9}$ to $V_{R17}$ fed from the MPX $13_1$, to 8 bits of the red data $D_R$ fed from the control circuit 2 in order to provide gray scales and, after having converted the gamma-corrected data to analog data red signals, feeds them to the corresponding voltage followers $15_1$, $15_4$, $15_7$, . . . , $15_{382}$. Similarly, the DAC $14_2$ makes the gamma correction, based on the set of green gray scale voltages $V_{G0}$ to $V_{G8}$ or the set of the green gray scale voltages $V_{G9}$ to $V_{G17}$ fed from the MPX $13_2$, to 8 bits of the green data $D_G$ fed from the control circuit 2 in order to provide gray scales and, after having converted the gamma-corrected data to analog data red signals, feeds them to the corresponding voltage followers $15_2$, $15_5$, $15_8$, . . . , $15_{383}$. The DAC $14_3$ makes the gamma correction, based on the set of blue gray scale voltages $V_{B0}$ to $V_{B8}$ or the set of the blue gray scale voltages $V_{B9}$ to $V_{B17}$ fed from the MPX $13_3$, to 8 bits of the blue data $D_B$ fed from the control circuit 2 in order to provide gray scales and, after having converted the gamma-corrected data to analog data red signals, feeds them to the corresponding voltage followers $15_3$, $15_6$, $15_9$, . . . , $15_{384}$. The voltage followers $15_1$ to $15_{384}$ apply the corresponding data red signal, data green signal, and data blue signal fed from the DAC $14_1$ to $14_3$ to the corresponding data electrode in the color liquid crystal display 1.

The scanning electrode driving circuit 5 shown in FIG. 17 produces scanning signals with the timing when the vertical scanning pulse PV is fed from the control circuit 2 and sequentially feeds the produced signals to corresponding scanning electrodes in the color liquid crystal display 1.

In the display device of the color liquid crystal display 1 provided with the driving circuit of the color liquid crystal display 1 having configurations described above, as shown in FIG. 20, the control circuit 2 and the gray scale power circuit 3 are mounted on a printed circuit board 16 while the data electrode driving sections $4_1$ to $4_{10}$ are mounted on ten pieces of film carrier tapes electrically connecting the printed circuit board 16 to the color liquid crystal display 1, that is, they are packaged in a form of TCPs (Tape Carrier Packages) $17_1$ to $17_{10}$. As shown in FIG. 21, the printed circuit board 16 is attached to an upper portion of a rear of a backlight 18 being approximately wedge-shaped in cross section which is attached to a rear of the color liquid crystal display 1. The backlight 18 has a point light source such as a white bulb or a like or a line light source such as a fluorescent lamp or a like, and a light diffusing member used to diffuse light emitted from these light sources to produce flat light and is adapted to uniformly illuminate the rear of the color liquid crystal display 1 from a rear side of the color liquid crystal display 1 being a non-light emitting display device.

The conventional color liquid crystal display 1 has a problem. That is, as described above, in the driving circuit of the conventional color liquid crystal display 1, since the gray scale power circuit 3 and the data electrode driving sections $4_1$ to $4_{10}$ are mounted individually and separately from each other, it is necessary to feed 54 pieces of gray scale voltages including the red gray scale voltages $V_{R0}$ to $V_{R17}$, green gray scale voltages $V_{G0}$ to $V_{G17}$, and blue gray scale voltages $V_{B0}$ to $V_{B17}$ to each of ten pieces of the data electrode driving sections $4_1$ to $4_{10}$. Two methods for feeding such gray scale voltages are available, however, each of them has a shortcoming as described below.

A first method is to form 54 pieces of wirings on a surface layer of the printed circuit board 16 and to connect each of the wirings to each of the TCPs $17_1$ to $17_{10}$. A pitch between the wirings being employed generally and presently is 1.27 mm. If, therefore, 54 pieces of wirings are to be formed, using the above pitch, on the surface layer of the printed circuit board 16, a depth of the printed circuit board 16 becomes longer by 2 cm or more, compared with a case where 54 pieces of gray scale voltages including the red gray scale voltages $V_{R0}$ to $V_{R17}$, green gray scale voltages $V_{G0}$ to $V_{G17}$, and blue gray scale voltages $V_{B0}$ to $V_{B17}$ are transferred serially using one wiring (refer to FIG. 20). This causes, as shown in FIG. 21, an area in which the printed circuit board 16 is mounted on the upper portion of the rear of the backlight 18 to become wider. Generally, the backlight 18 plays not only a part in illuminating uniformly the rear of the color liquid crystal display 1 but also a part in keeping a rear portion of the display device plane and can be used commonly for any color liquid crystal display 1 so long as it has the same screen in size. However, if the depth of the printed circuit board 16 is different in every type of the color liquid crystal display 1, that is, in every resolution that the color liquid crystal display 1 can provide, it is necessary to change a shape of the backlight 18 for every type of the color liquid crystal display 1, that is, every resolution to be provided by the color liquid crystal display 1, which causes an increase in costs of the display device.

The limit pitch between terminals of the typical TCP being presently employed is 300 $\mu$m when considerations are given to a level of pressure-based contact technology by which each of terminals of the TCP is put in contact with each of terminals of the printed circuit board 16 by using external pressure in order to obtain electrical conductivity. Therefore, if each of terminals being connected to 54 pieces of wirings formed on the surface layer of the printed circuit board 16 is connected to each of terminals formed on upper portions of the TCP $17_1$ to $17_{10}$ by using the pressure-based contact technology, each of widths WT of the TCP $17_1$ to $17_{10}$ becomes larger by 1.6 cm or more (refer to FIG. 20). As a result, in the case of the 18-inch type color liquid crystal display of the SXGA type in which ten pieces of the data electrode driving sections $4_1$ to $4_{10}$ have to be placed, since the fitting width for the TCP $17_1$ to $17_{10}$ becomes larger by 16 cm or more, there is a danger that it becomes physically impossible to mount ten pieces of the TCP $17_1$ to $17_{10}$ in alignment in a direction of the width $W_P$ of the printed circuit board 16 (see FIG. 20).

A second method is to form 54 pieces of wirings in an inner layer of the printed circuit board 16 and to connect each of them to each of the TCP $17_1$ to $17_{10}$. In this case, in order to connect the 54 pieces of wirings formed in the inner layer of the printed circuit board 16 to each of terminals formed on the upper portions of the TCP $17_1$ to $17_{10}$, the 54 pieces of wirings formed in the inner layer of the printed circuit board 16 have to be connected to 54 pieces of terminals formed via through holes on the surface layer of the printed circuit board 16 and being corresponded to the 54 pieces of wirings. Since a diameter of a typical through hole being presently employed is 0.8 mm, if the 54 pieces of such the through holes having the diameter of 0.8 mm are to be formed on the printed circuit board 16 in alignment, an area required for forming all the through holes has to become wider accordingly.

In both the first and second methods described above, if the number of gray scale voltages including the red gray scale voltages $V_{R0}$ to $V_{R17}$, green gray scale voltages $V_{G0}$ to $V_{G17}$, and blue gray scale voltages $V_{B0}$ to $V_{B17}$ is different, the pitch between wirings, depth $D_P$ of the printed circuit board 16, width $W_T$ of each of the TCP $17_1$ to $17_{10}$ are different and, therefore, the printed circuit board 16 and the TCP $17_1$ to $17_{10}$ have to be fabricated in a manner so as to meet the requirement in dimensions, which causes a big increase in costs of the display device.

SUMMARY OF THE INVENTION

In view of the above, it is an object of the present invention to provide a driving circuit of a color liquid crystal display which is capable of reducing a substrate packaging area, using a common substrate or TCP even when a resolution and/or the number of gray scale voltages that the color liquid crystal display provides are different, which enables the substrate, TCP, and a display device to be fabricated at low costs. It is also another object of the present invention to provide a color liquid crystal display device using the driving circuit described above and a method for driving the color liquid crystal display.

According to a first aspect of the present invention, there is provided a driving circuit of a color liquid crystal display including:

a data electrode driving circuit to drive the color liquid crystal display by using a gray scale voltage selected based on a video signal out of a plurality of gray scale voltages; and wherein the data electrode driving circuit produces a plurality of the gray scale voltages corresponding to a gray scale voltage characteristic based on digital gray scale voltage setting data to be supplied.

According to a second aspect of the present invention, there is provided a driving circuit of a color liquid crystal display for driving the color liquid crystal display by using a data red signal, a data green signal, and a data blue signal obtained by making an individual gamma correction to red data, green data, and blue data being digital video data in order to make corrections so that each of the red data, the green data, and the blue data matches a transmittance characteristic of each of a red color, a green color, and a blue color for a voltage applied in the color liquid crystal display, the driving circuit including:

a control circuit mounted separately from the color liquid crystal display and to output, during an invalid period having no bearing on a displaying period for the digital video data, information about the gamma correction to be made to the red data, the green data, and the blue data; and a data electrode driving circuit mounted in a vicinity of the color liquid crystal display and to drive the color liquid crystal display by using the data red signal, the data green signal, and the data blue signal obtained by making the gamma correction to the red data, the green data, and the blue data, based on information about the gamma correction to be made to the red data, the green data, and the blue data.

In the foregoing, a preferable mode is one wherein the control circuit is mounted on a printed circuit board attached to an upper portion of a rear of a backlight placed on a rear of the color liquid crystal display and wherein the data electrode driving circuit includes a plurality of data electrode driving sections to provide gray scales by making the gamma correction to the red data, the green data, and the blue data each corresponding to each of data electrodes of the color liquid crystal display, out of the red data, the green data, and the blue data and converts the gamma-corrected red data, the gamma-corrected green data, and the gamma-corrected blue data into an analog data red signal, an analog data green signal, and an analog data blue signal, such that the analog data red signal, the analog data green signal, and the analog data blue signal are output, and wherein each of the plurality of the data electrode driving sections is mounted on a corresponding film carrier tape connecting the printed circuit board to the color liquid crystal display.

Also, a preferable mode is one wherein the information about the gamma correction to be made to the red data, the green data, and the blue data, is made up of gray scale information to provide an instruction as to which gray scale voltage should be selected out of the gray scale voltages for the red data, the green data, and the blue data, and of gray scale voltage information to provide an instruction as to which gray scale voltage should be selected out of the plurality of the gray scale voltages.

Also, a preferable mode is one wherein the control circuit feeds the gray scale information and the gray scale voltage information to the data electrode driving circuit as serial data.

Also, a preferable mode is one wherein each of the data electrode driving sections includes:

a shift register to convert the serial data into parallel gray scale information and parallel gray scale voltage information, such that the parallel gray scale information and the parallel gray scale voltage information;

a storing section to store, in advance, a selection signal to provide an instruction as to which gray scale voltage should be selected as a plurality of gray scale voltages for the red data, the green data, and the blue data;

a decoder to decode the gray scale information and to output selection information to provide an instruction as to which gray scale voltage should be selected out of the plurality of the gray scale voltages for the red data, the green data, the and blue data;

a multiplexer to select any one of the gray scale voltgage based on the selection signal read from the storing section according to the selection information and to output the selected gray scale voltage as a plurality of red gray scale voltages, green gray scale voltages, and blue gray scale voltages; and a data signal output section to provide gray scales by making the gamma correction to the red data, the green data, and the blue data, based on the plurality of the red gray scale voltages, the green gray scale voltages, and the blue gray scale voltages and to convert the gamma-corrected red data, the gamma-corrected green data, and the gamma-corrected blue data into an analog data red signal, an analog data green signal, and an analog data blue signal.

Also, a preferable mode is one wherein the control circuit feeds the gray scale voltage information by using wirings prepared to supply the red data, the green data, and the blue data to the data electrode driving circuit.

Also, a preferable mode is one wherein a number of counts of clocks used to capture the red data, the green data, and the blue data in the data electrode driving circuit, is associated, in a one-to-one relationship, with an order in which the gray scale voltage information about the red data, the green data, and the blue data is fed to the data electrode driving circuit and wherein the number of counts of clocks is used as the gray scale information.

Also, a preferable mode is one wherein each of the data electrode driving sections includes:

a red gray scale voltage information storing section to store, in advance, a selection signal to provide an instruction as to which gray scale voltage should be selected as a plurality of the red gray scale voltages for the red data;

a green gray scale voltage information storing section to store, in advance, a selection signal to provide an instruction as to which gray scale voltage should be selected as a plurality of the green gray scale voltages for the green data;

a blue gray scale voltage information storing section to store, in advance, a selection signal to provide an instruction as to which gray scale voltage should be selected as a plurality of the blue gray scale voltages for the blue data;

a gray scale information count section to count a number of supplied clocks and to output selection information to provide an instruction as to which gray scale voltage should be selected out of a plurality of the gray scale voltages according to the number of counts of the clocks;

a multiplexer to select any one of gray scale voltages based on the selection signal read from the red gray scale information storing section, the green gray scale information storing section, and the blue gray scale information storing section according to the selection information and to output the selected gray scale voltage as a plurality of red gray scale voltages, a plurality of green gray scale voltages, and a plurality of blue gray scale voltages; and a data signal output section to provide gray scales by making the gamma correction to the red data, the green data, and the blue data based on the plurality of the red gray scale voltages, the green gray scale voltages, and the blue gray scale voltages and to convert the gamma-corrected red data, the gamma-corrected green data, and the gamma-corrected blue data into an analog data red signal, an analog data green signal, and an analog data blue signal, such that the analog data red signal, the analog data green signal, and the analog data blue signal are output.

Also, a preferable mode is one wherein the gamma correction includes the gamma correction which is made in order to arbitrarily provide a characteristic of luminance required in reproduced images to luminance of input images.

According to a third aspect of the present invention, there is provided a display device having a driving circuit of a color liquid crystal display including:

a data electrode driving circuit to drive the color liquid crystal display by using a gray scale voltage selected based on a video signal out of a plurality of gray scale voltages; and wherein the data electrode driving circuit produces a plurality of the gray scale voltages corresponding to a gray scale voltage characteristic based on digital gray scale voltage setting data to be supplied.

According to a fourth aspect of the present invention, there is provided a display device having a driving circuit of a color liquid crystal display for driving the color liquid crystal display by using a data red signal, a data green signal, and a data blue signal obtained by making an individual gamma correction to red data, green data, and blue data being digital video data in order to make corrections so that each of the red data, the green data, and the blue data matches a transmittance characteristic of each of a red color, a green color, and a blue color for a voltage applied in the color liquid crystal display, the driving circuit including:

a control circuit mounted separately from the color liquid crystal display and to output, during an invalid period having no bearing on a displaying period for the digital video data, information about the gamma correction to be made to the red data, the green data, and the blue data; and a data electrode driving circuit mounted in a vicinity of the color liquid crystal display and to drive the color liquid crystal display by using the data red signal, the data green signal, and the data blue signal obtained by making the gamma correction to the red data, the green data, and the blue data, based on information about the gamma correction to be made to the red data, the green data, and the blue data.

According to a fifth aspect of the present invention, there is provided a method for driving a color liquid crystal display by using a data red signal, a data green signal, and a data blue signal obtained by making an individual gamma correction to red data, green data, and blue data being digital video data in order to make corrections so that each of the red data, the green data and the blue data matches a transmittance characteristic of each of red, green, and blue colors for a voltage applied in the color liquid crystal display, the method including:

a step of feeding, from a control circuit mounted separately from the color liquid crystal display, during an invalid period having no bearing on a displaying period for the digital video data, information about the gamma correction to be made to the red data, the green data, and the blue data, to a data electrode driving circuit mounted in a vicinity of the color liquid crystal display and to drive the color liquid crystal display by using the data red signal, the data green signal, and the data blue signal obtained by making the gamma correction to the red data, the green data, and the blue data, based on information about the gamma correction to be made to the red data, the green data, and the blue data.

With the above configurations, the driving circuit of the color liquid crystal display incorporates the data electrode driving circuit adapted to drive the color liquid crystal display using the gray scale voltage selected based on the video signals out of a plurality of gray scale voltages and the data electrode driving circuit is so configured that a plurality of the gray scale voltages being able to correspond to gray scale voltage characteristics is produced based on digital gray scale voltage setting data and, therefore, the substrate packaging area can be reduced and even if the resolution of the color liquid crystal display and/or the number of the gray scale voltages are different, the common substrate and/or TCP can be used, which enables the substrate and/or TCP, that is, the display device to be manufactured at low costs.

With another configuration as above, during the invalid period having no bearing on the displaying period of the digital video data, information about the gamma correction to be made to the red data, the green data, and the blue data is transmitted serially from the control circuit mounted separately from the color liquid crystal display to the data electrode driving circuit adapted to drive the color liquid crystal display and, therefore, the number of wirings required to connect the control circuit to the data electrode driving circuit can be reduced.

With still another configuration as above, the information about the gamma correction to be made to the red data, the green data, and the blue data, during the invalid period, is supplied by using wirings prepared to feed the red data, the green data, and the blue data to the data electrode driving circuit and, therefore, effective use of the wirings is made possible.

With still another configuration as above, the red gray scale voltage, the green gray scale voltage, and the blue gray scale voltage can be set in one operation and, therefore, the processing is made simple and the time required for the setting can be shortened.

BRIEF DESCRIPTION OF THE DRAWINGS

The above and other objects, advantages, and features of the present invention will be more apparent from the following description taken in conjunction with the accompanying drawings in which:

FIG. 2 shows one example of relations between each of bits A5 to A0 of gray scale information and each of channels Ch R0 to Ch R17, Ch G0 to Ch G17, and Ch B0 to Ch B17 employed in the first embodiment of the present invention;

FIG. 3 shows one example of relations between each of bits D7 to D0 of gray scale voltage information and each of gray scale voltages $V_0$ to $V_{255}$ employed in the first embodiment of the present invention;

FIGS. 11A, 11B, and 11C show examples of relations between each of bits DR7 to DR0, DG7 to DG0, DB7 to DB0 of red gray scale voltage information $D_{R0}$ to $D_{R17}$, green gray scale voltage information $D_{G0}$ to $D_{G17}$ and blue gray scale voltage information $D_{B0}$ to $D_{B17}$ and each of gray scale voltages $V_0$ to $V_{255}$ employed in the second embodiment of the present invention;

DETAILED DESCRIPTION OF THE PREFERRED EMBODIMENTS

Best modes of carrying out the present invention will be described in further detail using various embodiments with reference to the accompanying drawings.

First Embodiment

Figure 1:
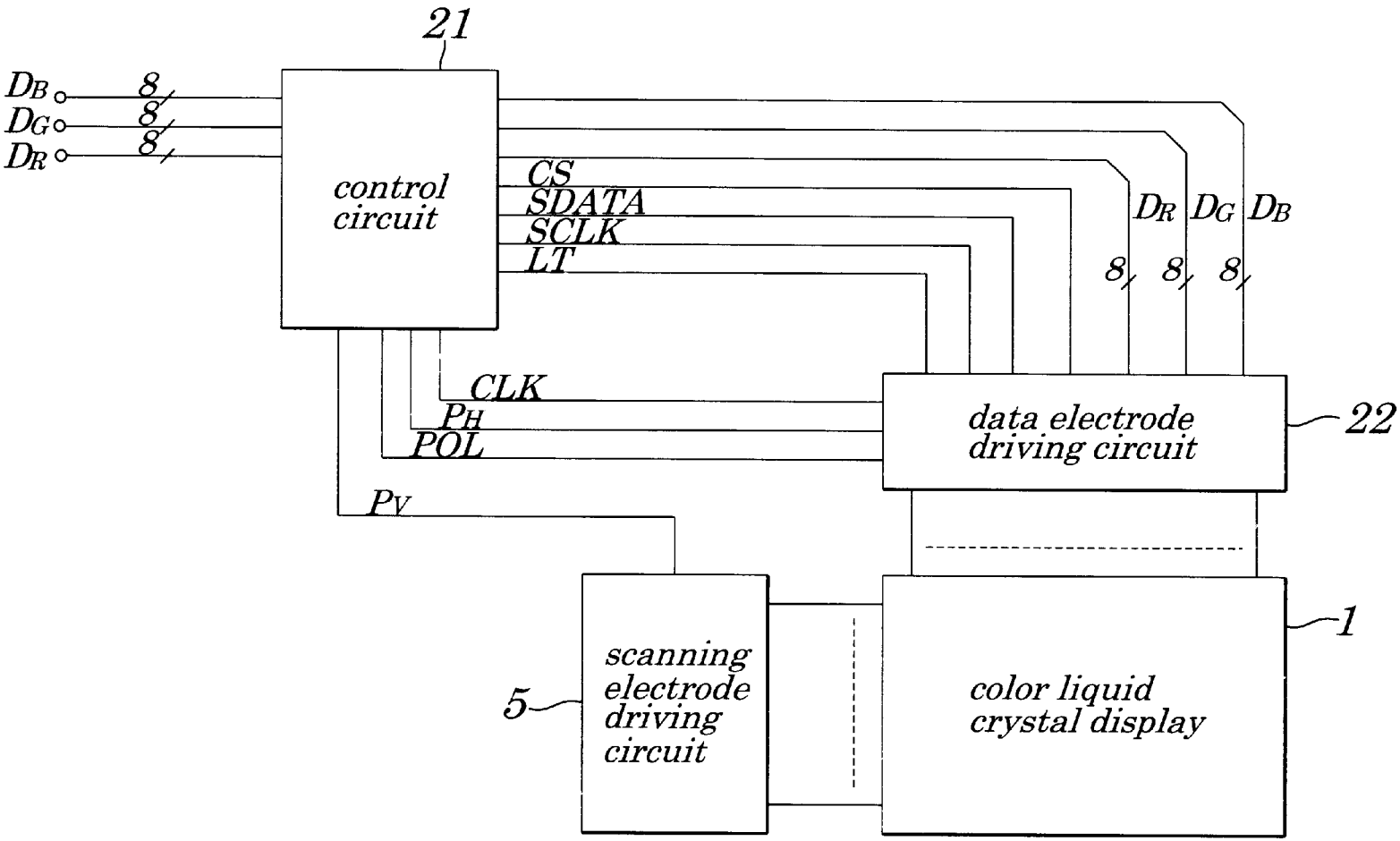
FIG. 1 is a block diagram showing configurations of a driving circuit of a color liquid crystal display according to a first embodiment of the present invention.
Figure 17:
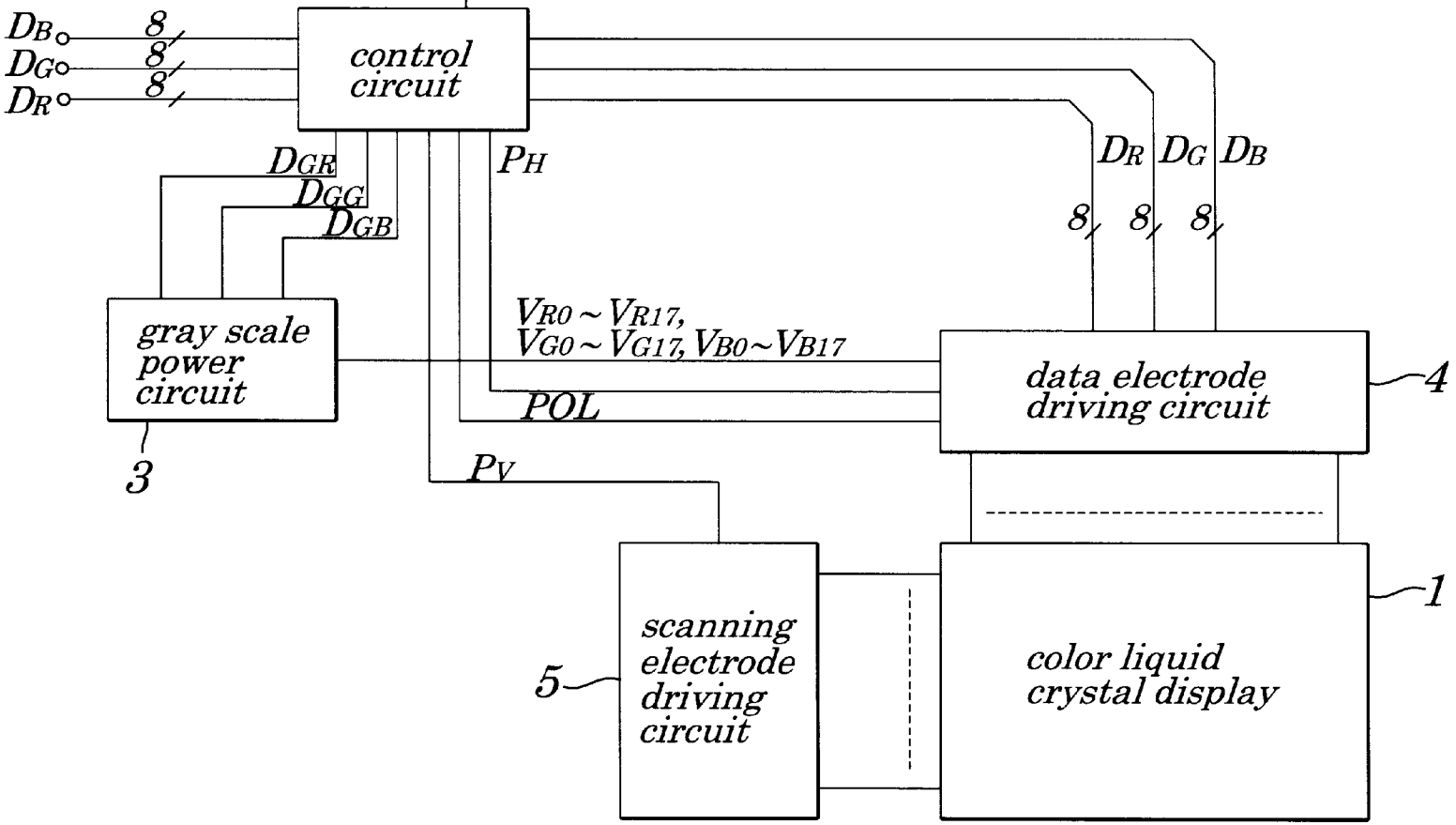
FIG.17 (PRIOR ART)
FIG. 17 is a schematic block diagram showing an example of configurations of a conventional driving circuit in a color liquid crystal display.
Figure 18:
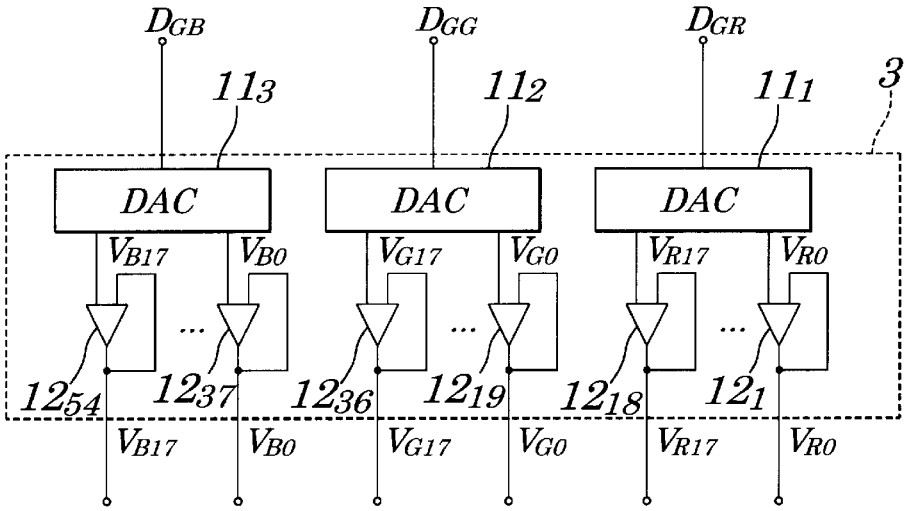
FIG. 18 (PRIOR ART)
FIG. 18 is a schematic block diagram showing an example of configurations of a gray scale power circuit 3 making up the conventional driving circuit of FIG. 17.
Figure 19:
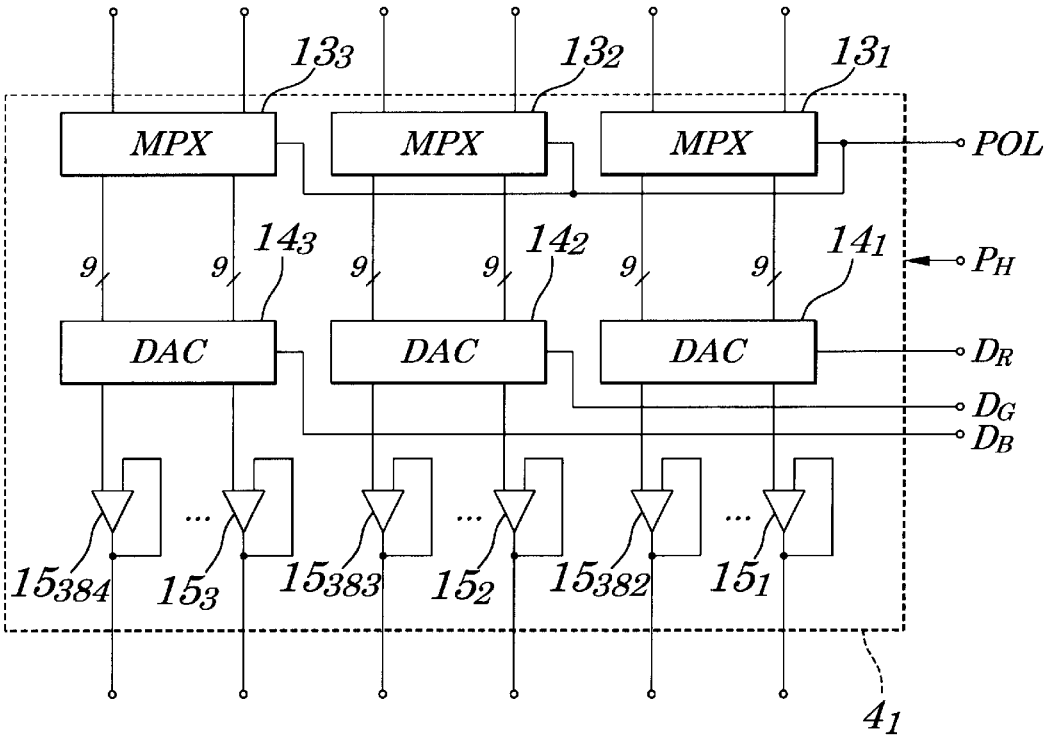
FIG. 19 (PRIOR ART)
FIG. 19 is a schematic block diagram showing an example of configurations of a data electrode driving section $\mathbf{4}_1$ making up a data electrode driving circuit 4 contained in the conventional driving circuit of FIG. 17.

FIG. 1 is a block diagram showing configurations of a driving circuit of a color liquid crystal display 1 according to a first embodiment of the present invention. In FIG. 1, same reference numbers are assigned to corresponding parts in FIG. 17 and their descriptions are omitted accordingly. In the color liquid crystal display 1 shown in FIG. 1, instead of a control circuit 2, a gray scale power circuit 3, and a data electrode driving circuit 4 shown in FIG. 17, a control circuit 21, and a data electrode driving circuit 22 are newly provided.

The control circuit 21 is made up of, for example, ASICs (Application Specific Integrated Circuits) and feeds 8 bits of red data $D_R$, 8 bits of green data $D_G$, and 8 bits of blue data $D_B$ which are all supplied from the outside, to the data electrode driving circuit 22 and, at the same time, produces a horizontal scanning pulse $P_H$, a vertical scanning pulse $P_V$, a polarity reversed pulse POL, a clock CLK, a chip selection signal CS, a shift clock SCLK, a latch signal LT, and a serial data SDATA, based on a horizontal sync signal and a vertical sync signal fed from the outside and then supplies them to both the data electrode driving circuit 22 and a scanning electrode driving circuit 5.

The clock CLK is used to capture the red data $D_R$, the green data $D_G$, and the blue data $D_B$ in data registers making up the data electrode driving circuit 22. The chip selection signal CS is a signal which goes "high" for a predetermined time during a period having no bearing on an image displaying period such as a vertical retrace interval, horizontal retrace interval, or a like (hereinafter referred to as an "invalid period"). The shift clock SCLK being asynchronous to the clock CLK is used to capture the serial data SDATA in the data electrode driving circuit 22. The latch signal LT is a signal used to provide timing with which, as shown in FIG. 5, a gray scale voltage information storing section 28 captures parallel information to be fed from a shift register 27 in "k" ("k" is a natural number) pieces of data electrode driving sections $\mathbf{22}_1$ to $\mathbf{22}_K$ (see FIG. 4)

The serial data SDATA is made up of (n+1) ("n" being a natural number) bits of parallel gray scale information and (m+1) ("m" being a natural number) bits of gray scale voltage information and is fed to the data electrode driving circuit 22, while the chip selection signal CS remains "high", in synchronization with the shift clock SCLK. The parallel gray scale information is used to provide an instruction as to which channel out of channels Ch R0 to Ch R17, Ch G0 to Ch G17, and Ch B0 to Ch B17 should be set to give the gray scale voltage to each of the red data $D_R$, the green data $D_G$, and the blue data $D_B$, in order to provide gray scales by making individual and separate gamma correction to each of the red data $D_R$, the green data $D_G$, and the blue data $D_B$. FIG. 2 shows one example of relations between each of bits of the parallel gray scale information A5 to A0 and each of the channels Ch R0 to Ch R17, Ch G0 to Ch G17, and Ch B0 to Ch B17 given when "n"=5.

The gray scale voltage information is used to provide an instruction as to which voltage out of 256 pieces of the gray scale voltages $V_0$ ($=V_{REF}/255\times0=0$[V]) to $V_{255}$ ($=V_{REF}/255\times255=V_{REF}$[V]) to be fed from a gray scale voltage supplying source 29 (see FIG. 5) to a multiplexer (MPX) 30 is to be selected in each of the data electrode driving sections $\mathbf{22}_1$ to $\mathbf{22}_K$ making up the data electrode driving circuit 22 (FIG. 1), in order to provide gray scales by making the individual and separate gamma correction to each of the red data $D_R$, the green data $D_G$ and the blue data $D_B$. A $V_{REF}$ denotes a reference voltage (FIG. 5). FIG. 3 shows one example of relations between each of bits of the gray scale voltage information D7 to D0 and each of parallel gray scale voltages $V_0$ to $V_{255}$ given when "m"=7. The gamma correction used in the first embodiment includes both the first and second gamma corrections described above.

Figure 4:
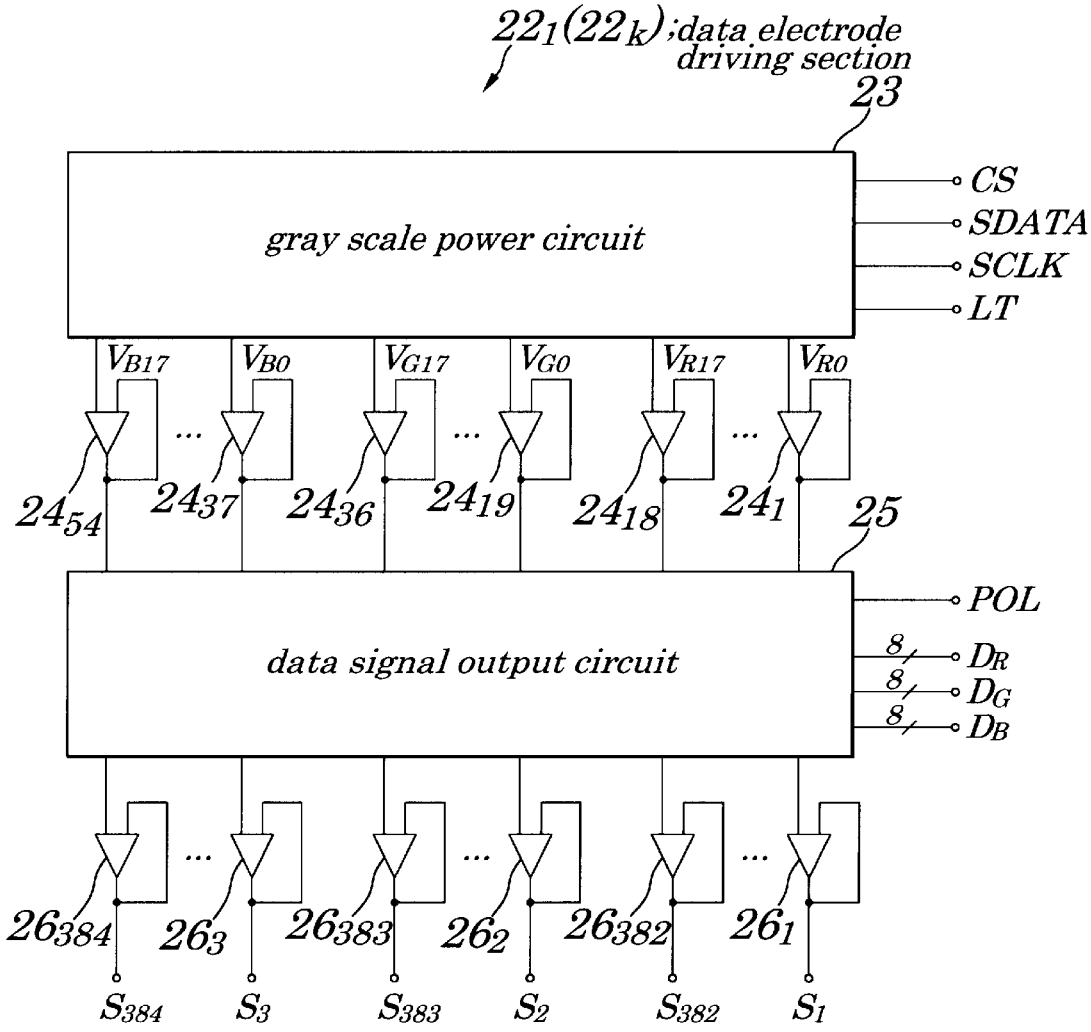
FIG. 4 is a schematic block diagram showing configurations of a data electrode driving section $\mathbf{22}_1$ being part of a data electrode driving circuit 22 making up the driving circuit of the color liquid crystal display according to the first embodiment of the present invention.
Figure 5:
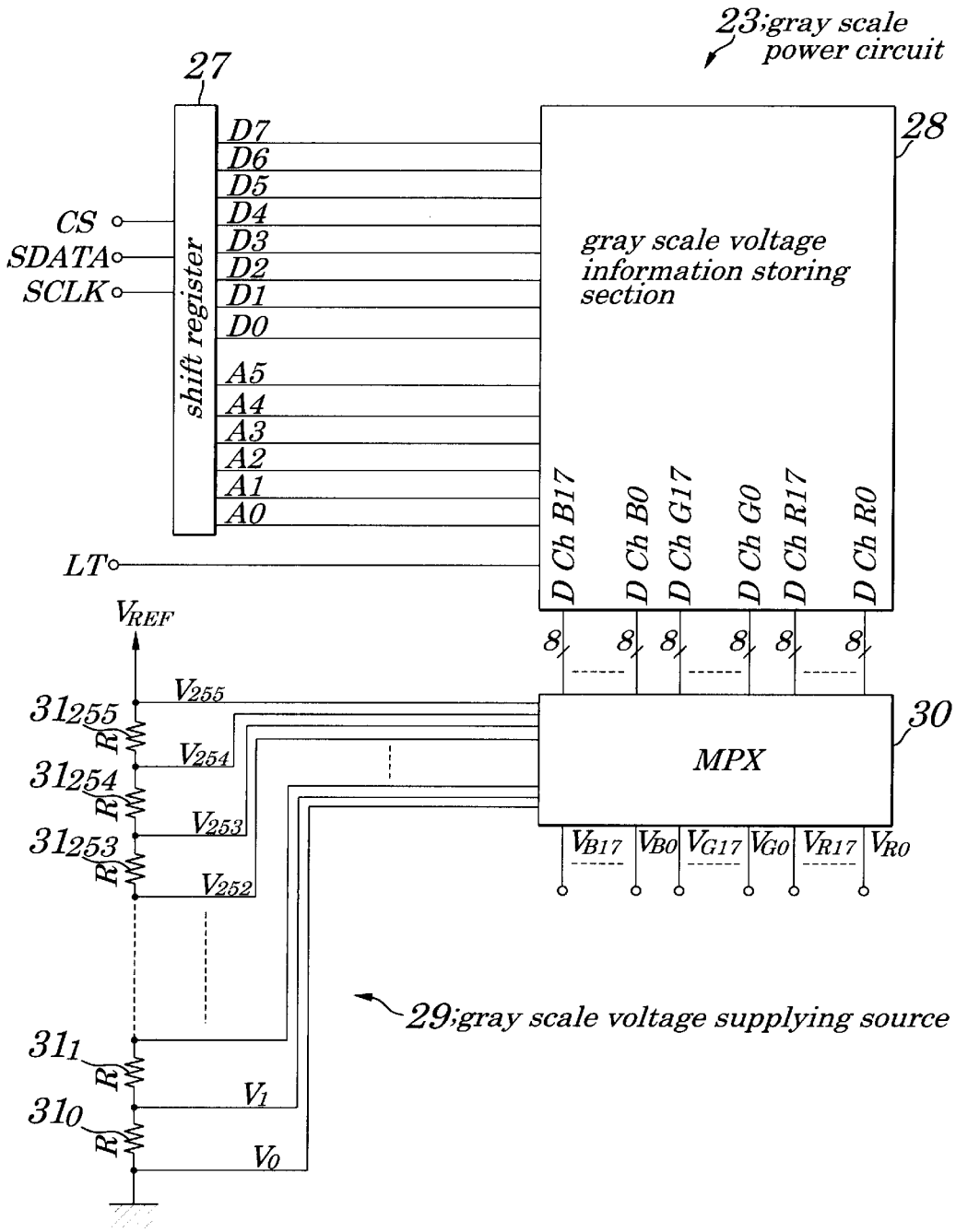
FIG. 5 is a schematic block diagram showing configurations of a gray scale power circuit 23 making up the data electrode driving section $\mathbf{22}_1$ of FIG. 4.

The data electrode driving circuit 22 shown in FIG. 1 includes "k" pieces of the data electrode driving sections $\mathbf{22}_1$ to $\mathbf{22}_k$ (FIG. 4). Each of the data electrode driving sections $\mathbf{22}_1$ to $\mathbf{22}_k$ makes the gamma correction to the red data $D_R$, green data $D_G$, and blue data $D_B$ corresponding to the data electrode in the color liquid crystal display 1, out of the red data $D_R$, the green data $D_G$, and the blue data $D_B$ fed from the control circuit 21, to provide gray scales, and converts the gamma-corrected data to 384 pieces of analog data signals $S_1$ to $S_{384}$ and then outputs the converted data (see FIG. 4). For example, if the color liquid crystal display 1 is of the SXGA (Super Extended Graphics Array) type, the data electrode driving circuit 22 includes ten pieces of the data electrode driving sections $\mathbf{22}_1$ to $\mathbf{22}_{10}$. Since all of the data electrode driving sections $\mathbf{22}_1$ to $\mathbf{22}_{10}$ have the same configurations except that each of their components and each of input and output signals have a different subscript, a description of only the data electrode driving section $\mathbf{22}_1$ will be provided below.

As shown in FIG. 4, the data electrode driving section $\mathbf{22}_1$ chiefly includes a gray scale power circuit 23, voltage followers $\mathbf{24}_1$ to $\mathbf{24}_{54}$, a data signal output circuit 25 and voltage followers $\mathbf{26}_1$ to $\mathbf{26}_{384}$. Moreover, though the data electrode driving section $\mathbf{22}_1$ actually has a shift register, data register, latch, level shifter or a like on a front stage (not shown) of the data signal output circuit 25, since their components and operations have no direct bearing on a characteristic portion of the present invention, descriptions of them are omitted in this specification. Therefore, in FIG. 4, a circuit providing the horizontal scanning pulse $P_H$ is not shown.

As shown in FIG. 5, the gray scale power circuit 23 includes a shift register 27, a gray scale voltage information storing section 28, a gray scale voltage supplying source 29, and an MPX 30. The shift register 27, while the chip selection signal CS remains "high", captures the serial data SDATA in synchronization with the shift clock SCLK and outputs 8 bits of parallel gray scale information A5 to A0 and 8 bits of the parallel gray scale voltage information D7 to D0.

The gray scale voltage information storing section 28 is made up of a semiconductor memory such as a ROM, RAM, flash memory EEPROM (Electrically erasable PROM) or a like and mainly includes a storing section (not shown) in which each of 8 bits of selection signals D Ch R0 to D Ch R17, D Ch G0 to D Ch G17, and D Ch B0 to D Ch B17 is stored in each of the channels Ch R0 to Ch R17, Ch G0 to Ch G17, and Ch B0 to Ch B17, respectively, and a decoder (not shown) used to decode 6 bits of the parallel gray scale information A5 to A0 fed from the shift register 27 and to output selection information SChR0 to SChR17, SChG0 to SChG17, and SChB0 to SChB17 (not shown) each of which provides an instruction as to which channel is to be selected out of the channels Ch R0 to Ch R17, Ch G0 to Ch G17, and Ch B0 to Ch B17. The gray scale voltage information storing section 28, with timing when the latch signal LT fed from the control circuit 21 goes "high", captures 6 bits of the parallel gray scale information A5 to A0 fed from the shift register 27 and 8 bits of the parallel gray scale voltage information D7 to D0 in an inside of the gray scale voltage information storing section 28 and outputs any one of 8 bits of the selection signals D Ch R0 to D Ch R17, D Ch G0 to D Ch G17, and D Ch B0 to D Ch B17 selected based on the parallel gray scale voltage information D7 to D0 from the channel selected based on the selection information SChR0 to SChR17, SChG0 to SChG17, and SChB0 to SChB17 (not shown) obtained by decoding the gray scale information A5 to A0 and then feeds them to the MPX 30.

The gray scale voltage supplying source 29 is provided with 255 pieces of resistors $\mathbf{31}_1$ to $\mathbf{31}_{255}$ each having the same resistance value and being connected serially between a terminal of the reference voltage $V_{REF}$ and a terminal of a ground and feeds 256 pieces of the gray scale voltages $V_0$($=V_{REF}/255\times0=0$[V]) to $V_{255}$ ($=V_{REF}/255\times255=V_{REF}$[V]) to the MPX 30. The MPX 30 selects any one of the 256 pieces of the gray scale voltages $V_0$ to $V_{255}$ fed from the gray scale voltage supplying source 29 based on the 8 bits of the selection signals D Ch R0 to D Ch R17, D Ch G0 to D Ch G17, and D Ch B0 to D Ch B17 fed from the gray scale voltage information storing section 28 and outputs it as one of analog red gray scale voltages $V_{R0}$ to $V_{R17}$, or one of analog green gray scale voltages $V_{G0}$ to $V_{17}$, or one of analog blue gray scale voltages $V_{B0}$ to $V_{B17}$.

The voltage followers $\mathbf{24}_1$ to $\mathbf{24}_{54}$ shown in FIG. 4 feed the analog red gray scale voltages $V_{R0}$ to $V_{R17}$, analog green gray scale voltages $V_{G0}$ to $V_{G17}$, and analog blue gray scale voltages $V_{B0}$ to $V_{B17}$ which are all required for making the gamma correction, as they are, to the data signal output circuit 25. The data signal output circuit 25 splits each of the analog red gray scale voltages $V_{R0}$ to $V_{R17}$, analog green gray scale voltages $V_{G0}$ to $V_{G17}$, and analog blue gray scale voltages $V_{B0}$ to $V_{B17}$ into 256 pieces of the red gray scale voltages $V_{GR0}$ to $V_{GR255}$, 256 pieces of the green gray scale voltages $V_{GG0}$ to $V_{GG255}$, and 256 pieces of the blue gray scale voltages $V_{GB0}$ to $V_{GB255}$, respectively and, based on a set of the red gray scale voltages $V_{GR0}$ to $V_{GR127}$ or a set of the red gray scale voltages $V_{GR128}$ to $V_{GR255}$, a set of the green gray scale voltages $V_{GG0}$ to $V_{GG127}$ or a set of the green gray scale voltages $V_{GG128}$ to $V_{GG255}$, a set of the blue gray scale voltages $V_{GB0}$ to $V_{GB127}$ or a set of the blue gray scale voltages $V_{GB128}$ to $V_{GB255}$ switched according to the polarity reversed pulse POL fed from the control circuit 21, makes the gamma correction to the 8 bits of the red data $D_R$, 8 bits of the green data $D_R$, and the 8 bits of the blue data $D_R$ to provide gray scales and, at the same time, converts the gamma-corrected data to analog data red signals $S_1, S_4, \ldots, S_7, S_{382}$, analog data green signals $S_2, S_5, \ldots, S_8, S_{383}$, and analog data blue signals $S_3, S_6, \ldots, S_9, S_{384}$, and then feeds the converted data to each of the voltage followers $\mathbf{26}_1$ to $\mathbf{26}_{384}$. The voltage followers $\mathbf{26}_1$ to $\mathbf{26}_{384}$ feed the data red signals $S_1, S_4, \ldots, S_7, S_{382}$, data green signals $S_2, S_5, \ldots, S_8, S_{383}$, and data blue signals $S_3, S_6, \ldots, S_9, S_{384}$, as they are, to each of the corresponding data electrodes in the color liquid crystal display 1.

The data signal output circuit 25 shown in FIG. 4 is made up of three data signal output sections $\mathbf{25}_R$, $\mathbf{25}_G$, and $\mathbf{25}_B$ corresponding to each of the red data $D_R$, green data $D_G$, and blue data $D_B$. Since all of the data signal output sections $\mathbf{25}_R$, $\mathbf{25}_G$, and $\mathbf{25}_B$ have the same configurations except that each of their components and each of input and output signals have a different subscript, a description of only the data signal output section $\mathbf{25}_R$ (FIG. 6) will be provided below.

Figure 6:
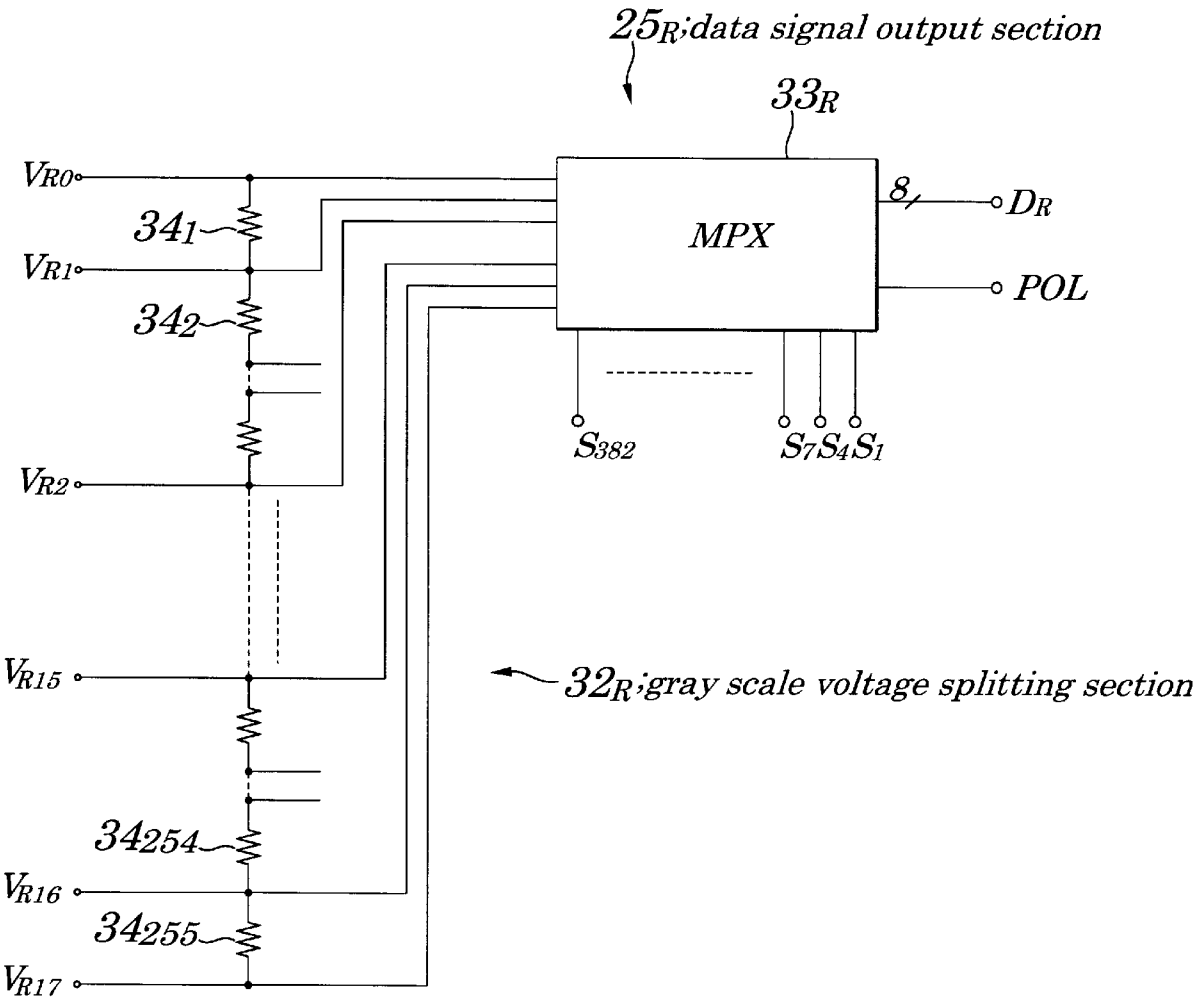
FIG. 6 is a schematic block diagram showing configurations of a data signal output section $\mathbf{25}_R$ being part of a data signal output circuit 25 making up the data electrode driving section $\mathbf{22}_1$ of FIG. 4.

The data signal output section $\mathbf{25}_R$, as shown in FIG. 6, is made up of a gray scale voltage splitting section $\mathbf{32}_R$ and an MPX $\mathbf{33}_R$. The gray scale voltage splitting section $\mathbf{32}_R$ is provided with 255 pieces of resistors $\mathbf{34}_1$ to $\mathbf{34}_{255}$ each having a different resistance value and being connected serially, and splits the red gray scale voltages $V_{R0}$ to $V_{R17}$ fed from the voltage followers $\mathbf{24}_1$ to $\mathbf{24}_{18}$ into 256 pieces of the red gray scale voltages $V_{GR0}$ to $V_{GR255}$ and feeds them to the MPX $\mathbf{33}_R$. The MPX $\mathbf{33}_R$ makes the gamma correction to the 8 bits of the red data $D_R$ fed from the control circuit 21 to provide gray scales, based on a set of the red gray scale voltages $V_{GR0}$ to $V_{GR127}$ or a set of the red gray scale voltages $V_{GR128}$ to $V_{GR255}$ switched by the polarity reversed pulse POL fed from the control circuit 21 out of 256 pieces of the red gray scale voltages $V_{GR0}$ to $V_{GR255}$ fed from the gray scale voltage splitting section $\mathbf{32}_R$ and, at the same time, converts the gamma-corrected data to the analog data red signals $S_1, S_4, S_7, \ldots, S_{382}$, and then feeds the converted signals to the voltage followers $\mathbf{26}_1, \mathbf{26}_4, \mathbf{26}_7, \ldots, \mathbf{26}_{382}$.

Figure 7:
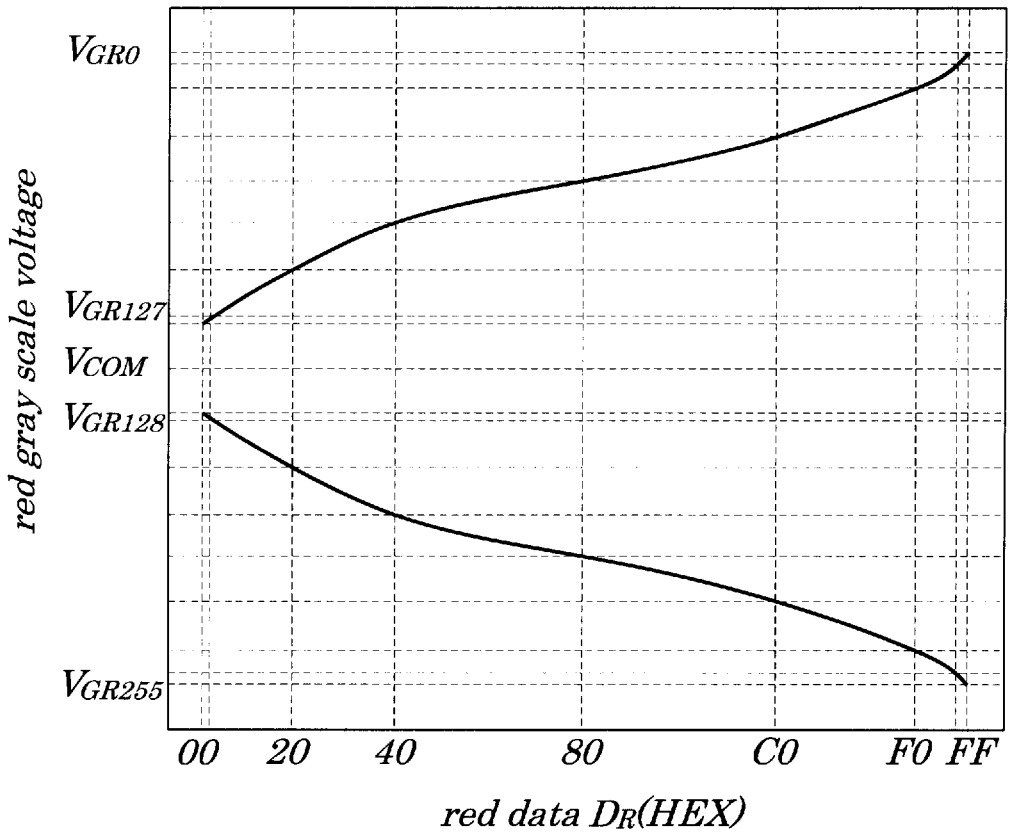
FIG. 7 is a diagram showing one example of a relation between 8 bits of red data $D_R$ to be fed to the data signal output section $\mathbf{25}_R$ and red gray scale voltages $V_{GR0}$ to $V_{GR127}$ and $V_{GR128}$ to $V_{GR255}$ employed in the driving circuit of the color liquid crystal display according to the first embodiment of the present invention.

FIG. 7 is a diagram showing one example of relations between 8 bits of the red data DR (expressed in hexadecimal) to be fed to the data signal output section $\mathbf{25}_R$ and red gray scale voltages $V_{GR0}$ to $V_{GR127}$ and $V_{GR128}$ to $V_{GR255}$. As is apparent from FIG. 7, in the data signal output section $\mathbf{25}_R$, in order to provide gray scales by making the gamma correction including the first and second gamma corrections to the red data $D_R$, a set of the red gray scale voltages $V_{GR0}$ to $V_{GR127}$ and a set of the red gray scale voltages $V_{GR128}$ to $V_{GR255}$ having voltages being non-linear to the data value of the red data $D_R$ are supplied from the gray scale voltage splitting section $\mathbf{32}_R$ to the MPX $\mathbf{33}_R$.

Figure 20:
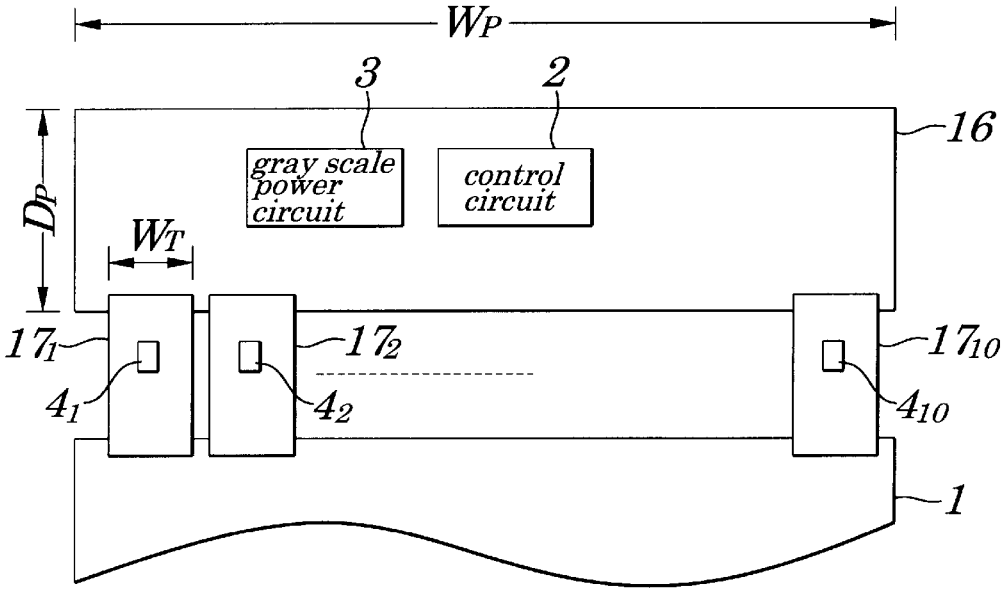
FIG.20 (PRIOR ART)
FIG. 20 is a schematic block diagram illustrating a packaging state in the conventional driving circuit of FIG. 17.
Figure 21:
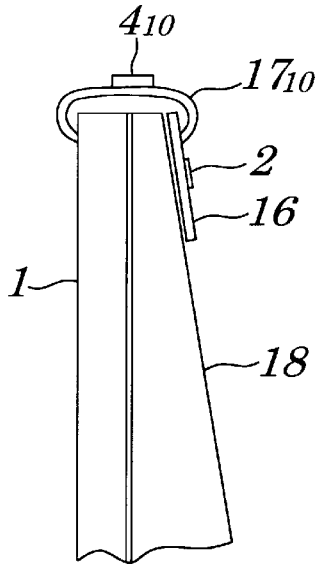
FIG.21 (PRIOR ART)
FIG. 21 is a schematic block diagram illustrating another packaging state in the conventional driving circuit of FIG. 17.

In the display device provided with the driving circuit of the color liquid crystal display 1 having configurations of the present invention described above, if the configurations are explained by analogy with configuration shown in FIGS. 20 and 21, only the control circuit 21 (compared to the control circuit 2) is mounted on the printed circuit board 16 while the data electrode driving sections $\mathbf{22}_1$ to $\mathbf{22}_{10}$ are mounted on ten pieces of film carrier tapes electrically connecting the printed circuit board 16 to the color liquid crystal display 1, that is, they are packaged in the form of TCPs (Tape Carrier Packages) $\mathbf{17}_1$ to $\mathbf{17}_{10}$ and the printed circuit board 16 is attached to an upper of a rear of a backlight 18 being wedge-shaped in cross section which has been mounted on a rear of the color liquid crystal display 1.

Next, operations of the control circuit 21 and data electrode driving circuit 22 being characteristic portions of the present invention, out of operations of the driving circuit of the color liquid crystal display 1 having configurations described above, will be explained by referring to the timing charts shown in FIGS. 8 and 9.

Figure 8:
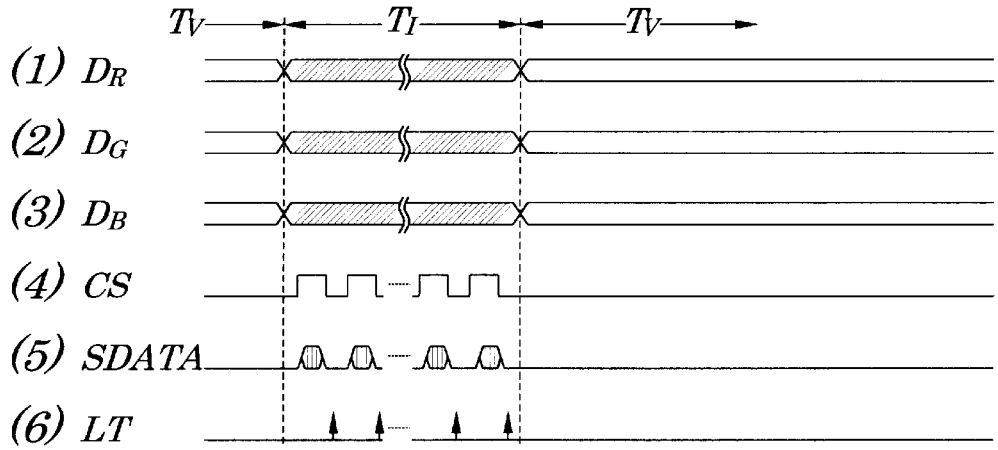
FIG. 8 is a timing chart explaining one example of operations of the driving circuit of the color liquid crystal display according to the first embodiment of the present invention.
Figure 9:
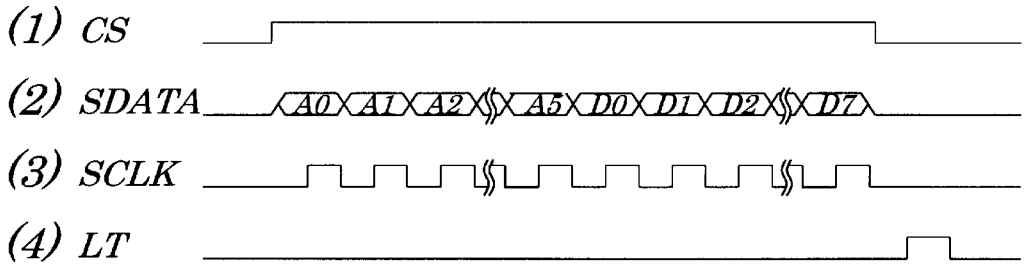
FIG. 9 is also a timing chart explaining another example of operations of the driving circuit of the color liquid crystal display according to the first embodiment of the present invention.

The control circuit 21, during an invalid period $T_I$ being a period having no bearing on the image displaying period such as an vertical retrace interval or horizontal retrace interval or a like, for example, after power has been applied to the display device provided with the driving circuit of the color liquid crystal display 1 of the embodiment, feeds a chip selection signal CS, a serial data SDATA, a shift clock SCLK, and a latch signal LT to the data electrode driving circuit 22, with timing shown by (4) to (6) in FIG. 8, more particularly, with timing shown by (1) to (4) in FIG. 9. That is, the control circuit 21, during the invalid period $T_I$, makes the chip selection signal CS shown by (1) in FIG. 9 go "high" for a predetermined period and feeds the serial data SDATA made up of 6 bits of the gray scale information A5 to A0 (see FIG. 2) used to provide an instruction as to which channel out of channels Ch R0 to Ch R17, Ch G0 to Ch G17, and Ch B0 to Ch B17 should be set to give the gray scale voltage to each of the red data $D_R$, green data $D_G$, and blue data $D_B$ as shown in (2) in FIG. 9 and 8 bits of the gray scale voltage information D7 to D0 (see FIG. 3) used to provide an instruction as to which gray scale voltage out of 256 pieces of the gray scale voltages $V_0$ to $V_{255}$, in synchronization with the shift clock SCLK shown by (3) in FIG. 9, to the data electrode driving circuit 22 and then feeds the latch signal LT shown by (4) in FIG. 9 to the data electrode driving circuit 22.

By above operations, in each of the data electrode driving sections $\mathbf{22}_1$ to $\mathbf{22}_{10}$ making up the data electrode driving circuit 22, the shift register 27 making up the gray scale power circuit 23, while the chip selection signal CS is "high", captures the serial data SDATA in synchronization with the shift clock SCLK and outputs 6 bits of parallel gray scale information A5 to A0 and 8 bits of parallel gray scale voltage information D7 to D0 and feeds them to the gray scale voltage information storing section 28. Then, the gray scale voltage information storing section 28 captures 6 bits of the parallel gray scale information A5 to A0 and 8 bits of the parallel gray scale voltage information D7 to D0 fed from the shift register 27 with timing when the latch signal LT fed from the control circuit 21 goes "high" (see (4) in FIG. 9) and outputs any one of 8 bits of the selection signals D Ch R0 to D Ch R17, D Ch G0 to D Ch G17, and D Ch B0 to D Ch B17 selected based on the parallel gray scale voltage information D7 to D0 and then feeds it to the MPX 30 from the channel selected based on the selection signals S Ch R0 to S Ch R17, S Ch G0 to S Ch G17, and S Ch B0 to S Ch B17 obtained by decoding the parallel gray scale information A5 to A0 using the decoder (not shown).

Next, the MPX 30 selects any one of the 256 pieces of the gray scale voltages $V_0$ to $V_{255}$ fed from the gray scale voltage supplying source 29 based on the 8 bits of selection signals D Ch R0 to D Ch R17, D Ch G0 to D Ch G17, and D Ch B0 to D Ch B17 fed from the gray scale voltage information storing section 28 and outputs them as analog red gray scale voltages $V_{R0}$ to $V_{R17}$, analog green gray scale voltages $V_{G0}$ to $V_{G17}$, and analog blue gray scale voltages $V_{B0}$ to $V_{B17}$ and, therefore, the voltage followers $\mathbf{24}_1$ to $\mathbf{24}_{54}$ shown in FIG. 4 feed corresponding red gray scale voltages $V_{R0}$ to $V_{R17}$, green gray scale voltages $V_{G0}$ to $V_{G17}$, and blue gray scale voltages $V_{B0}$ to $V_{B17}$, as they are, to the data signal output circuit 25.

By above operations, in each of the data signal output sections $\mathbf{25}_R$, $\mathbf{25}_G$, and $\mathbf{25}_B$, each of the gray scale voltage splitting sections $\mathbf{32}_R$, $\mathbf{32}_G$ and $\mathbf{32}_B$ splits the red gray scale voltages $V_{R0}$ to $V_{R17}$, green gray scale voltages $V_{G0}$ to $V_{G17}$ and blue gray scale voltages $V_{B0}$ to $V_{B17}$ fed from the voltage followers $\mathbf{24}_1$ to $\mathbf{24}_{54}$ into 256 pieces of red gray scale voltages $V_{GR0}$ to $V_{GR255}$, 256 pieces of green gray scale voltages $V_{GG0}$ to $V_{GG255}$ and 256 pieces of blue gray scale voltages $V_{GB0}$ to $V_{GB255}$ and feeds them to the MPX $\mathbf{33}_R$, $MPX_G$, and MPX $\mathbf{33}_B$.

By the above-described operations repeated sequentially during the invalid period $T_I$ shown in FIG. 8, the red gray scale voltages $V_{GR0}$ to $V_{GR255}$, green gray scale voltages $V_{GG0}$ to $V_{GG255}$, and blue gray scale voltages $V_{GB0}$ to $V_{GB255}$ to which considerations have been given in order to make the most of luminance in the minimum to the maximum range of V–T characteristics corresponding to the red, green, and blue colors for the color liquid crystal display 1, are set to the MPX $\mathbf{33}_R$, MPX $\mathbf{33}_G$ and MPX $\mathbf{33}_B$.

In such the state described above, the control circuit 21, as shown in (1) to (3) in FIG. 8, during the valid period $T_V$ being a period having a bearing on image displaying period of a color image signal, feeds 8 bits of the red data $D_R$, green data $D_G$, and blue data $D_B$ fed from the outside to the data electrode driving circuit 22 in synchronization with the clock CLK to the data electrode driving circuit 22.

By the above operations, each of the data electrode driving sections $\mathbf{22}_1$ to $\mathbf{22}_{10}$ making up the data electrode driving circuit 22, based on a set of the red gray scale voltages $V_{GR0}$ to $V_{GR127}$ or a set of the red gray scale voltages $V_{GR128}$ to $V_{GR255}$, a set of the green gray scale voltages $V_{GG0}$ to $V_{GG127}$ or a set of the green gray scale voltages $V_{GG128}$ to $V_{GG255}$, and a set of the blue gray scale voltages $V_{GB0}$ to $V_{GB127}$ or a set of the blue gray scale voltages $V_{GB128}$ to $V_{GB255}$ all of which have been switched based on the polarity reversed pulse POL fed from the control circuit 21, out of the 256 pieces of red gray scale voltages $V_{GR0}$ to $V_{GR255}$, 256 pieces of green gray scale voltages $V_{GG0}$ to $V_{GG255}$, and 256 pieces of blue gray scale voltages $V_{GB0}$ to $V_{GB255}$, makes the gamma correction to 8 bits of the red data $D_R$, 8 bits of the green data $D_G$ and 8 bits of the blue data $D_B$ fed from the control circuit 21 to provide gray scales and, after having converted the gamma-corrected data to analog data red signals, analog data green signals, and analog data blue signals and causes the voltage followers $\mathbf{26}_1$ to $\mathbf{26}_{384}$ in the data electrode driving circuit $\mathbf{22}_1$ to apply each of these analog signals to each of the corresponding data electrodes in the color liquid crystal display 1.

Thus, according to the configurations of the embodiment, since the gray scale power circuit 23 is mounted inside the data electrode driving sections $\mathbf{22}_1$ to $\mathbf{22}_{10}$ even when wirings are formed on the surface layer of the printed circuit board 16 by the conventional first method described above, the required number of the wirings is only four each being used to transmit the chip selection signal CS, serial data SDTA, shift clock SCLK, and latch signal LT and, as a result, it is possible to reduce fifty pieces of wirings and to prevent the length of a depth $D_P$ of the printed circuit board 16 (see FIG. 20) from becoming large and the area (see FIG. 20) required for the printed circuit board 16 to be mounted on the upper portion of the rear of the backlight 18 (FIG. 21) from becoming large. Therefore, even if the type of the color liquid crystal display 1, that is, its resolution is different, the backlight 18 being commonly applicable to any type of the color liquid crystal display 1 can be used and no increase in costs of the display device occurs. Moreover, since a width $W_T$ (see FIG. 20) of TCP $\mathbf{17}_1$ to $\mathbf{17}_{10}$ does not become larger, it is possible to easily mount ten pieces of the TCP $\mathbf{17}_1$ to $\mathbf{17}_{10}$ in the direction of the width $W_T$ of the TCP $\mathbf{17}_1$ to $\mathbf{17}_{10}$ (see FIG. 20).

On the other hand, even when the wirings are formed on the inner layer of the printed circuit board 16 by the conventional second method described above, the required number of the wirings is only four. Therefore, even when the four wirings formed on the inner layer of the printed circuit board 16 are to be connected to four wirings connected to corresponding four terminals formed on the surface layer of the printed circuit board 16 through the through hole, it is not necessary to make large the area required for forming all the through holes.

Moreover, according to the configurations of the embodiment, since the gray scale power circuit 23 is mounted inside the data electrode driving sections $\mathbf{22}_1$ to $\mathbf{22}_{10}$, even when the number of the gray scale voltages including the red gray scale voltages $V_{R0}$ to $V_{R17}$, green gray scale voltages $V_{G0}$ to $V_{G17}$, and blue gray scale voltages $V_{B0}$ to $V_{B17}$ is different, the area required for forming all the through holes, depth $D_P$ of the printed circuit board 16 and the width $W_T$ of each of the TCP $\mathbf{17}_1$ to $\mathbf{17}_{10}$ remain unchanged and, as a result, even if the type of the color liquid crystal display 1, that is, its resolution is different, the printed circuit board 16 and the TCP $\mathbf{17}_1$ to $\mathbf{17}_{10}$ being able to be commonly applied to any type of the color liquid crystal display 1 can be used, which can avoid an increase in costs of the printed circuit board 16 and the TCP $\mathbf{17}_1$ to $\mathbf{17}_{10}$ and, therefore, can prevent the costs of the display device from being increased.

Thus, according to the first embodiment, the substrate packaging area can be reduced and even if the resolution of the color liquid crystal display 1 and/or the number of the gray scale voltages are different, the common substrate and/or TCP can be used, which enables the substrate and/or TCP, that is, the display device to be manufactured at low costs.

It is needless to say that, as in the conventional case, it is possible to provide gray scales and to obtain a reproduced image having excellent gray scales by employing the optimum gamma corrections. Moreover, the driving circuit of the present invention can be used in the color liquid crystal display 1 having the high V–T characteristics.

Furthermore, when a collapse of the gray scale in any specified color out of the red, green, and blue colors occurs, the collapse can be recovered by providing changed gray scale information and a changed gray scale voltages, which are to be fed by the control circuit 21 to the data electrode driving circuit 22, adapted to change the gray scale voltage (any one of the voltages $V_{R0}$ to $V_{R17}$, $V_{G0}$ to $V_{G17}$, and $V_{B0}$ to $V_{B17}$) corresponding to a region of the color in which the collapse of the gray scale has occurred (any one of an area near a white level, area near gray level, and area near black level).

Second Embodiment

Figure 10:
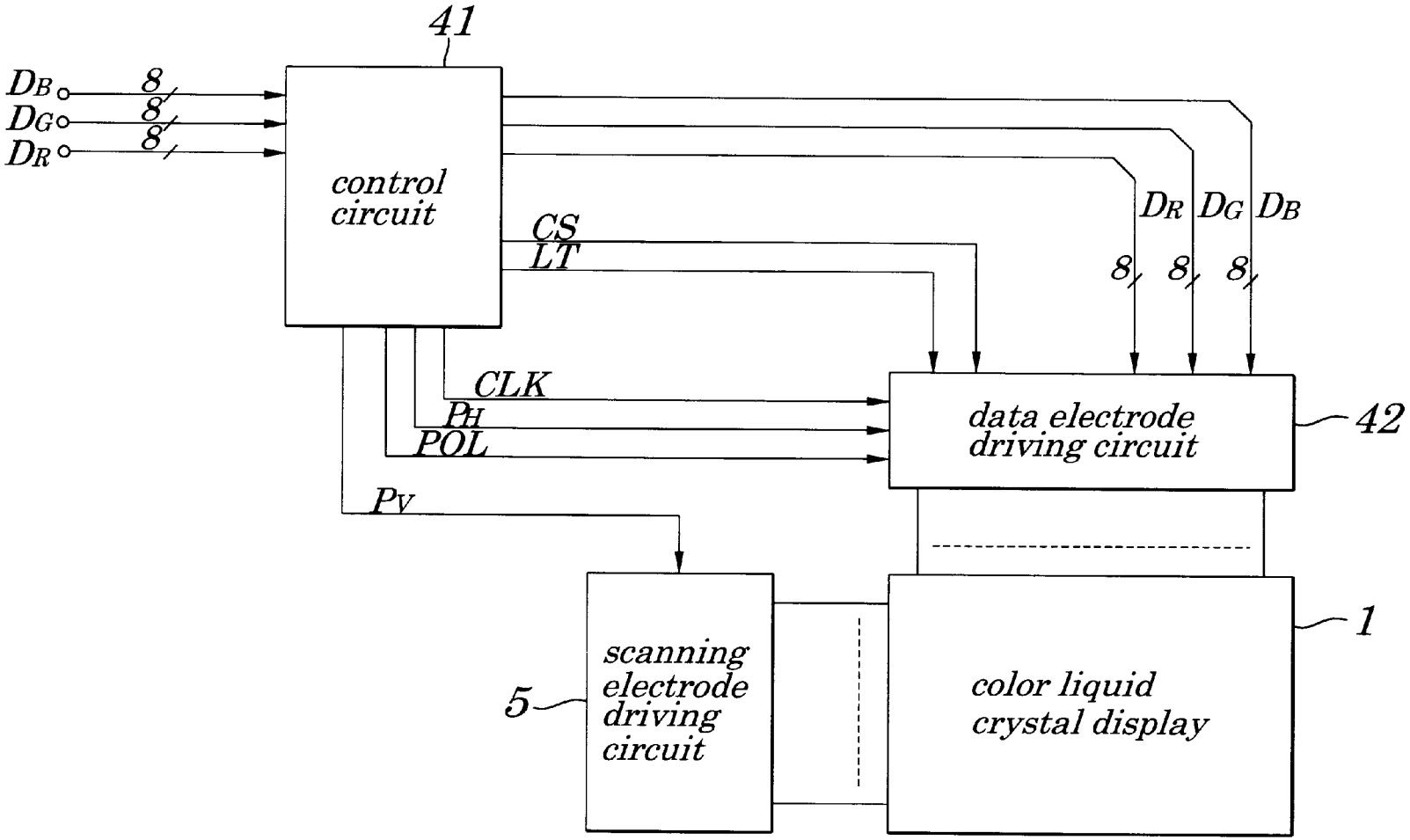
FIG. 10 is a block diagram showing configurations of a driving circuit of a color liquid crystal display according to a second embodiment of the present invention.

FIG. 10 is a block diagram showing configurations of a driving circuit of a color liquid crystal display 1 according to a second embodiment of the present invention. In FIG. 10, same reference numbers are assigned to corresponding parts in FIG. 1 and their descriptions are omitted accordingly. In the driving circuit of the color liquid crystal display 1 shown in FIG. 10, instead of a control circuit 21 and a data electrode driving circuit 22 shown in FIG. 1, a control circuit 41 and a data electrode driving circuit 42 are newly mounted.

The control circuit 41 is made up of, for example, ASICs and feeds 8 bits of red data $D_R$, 8 bits of green data $D_G$, and 8 bits of blue data $D_B$ supplied from the outside to the data electrode driving circuit 42. The control circuit 41 also produce, based on a horizontal sync signal and a vertical sync signal fed from the outside, a horizontal scanning pulse $P_H$, vertical scanning pulse $P_V$, polarity reversed pulse POL, clock CLK, chip selection signal CS, and latch signal LT and feeds them to the data electrode driving circuit 42 and a scanning electrode driving circuit 5.

The clock CLK is used to capture the red data $D_R$, green data $D_G$, and blue data $D_B$ in data registers (not shown) making up the data electrode driving circuit 42. The chip selection signal CS is a signal which goes "high" for a predetermined period during an invalid period having no bearing on an image displaying period such as a vertical retrace interval, horizontal retrace interval, or a like. The latch signal LT is a signal used to provide timing with which, in k ("k" is a natural number) pieces of data electrode driving sections $\mathbf{42}_1$ to $\mathbf{42}_K$ (see FIG. 12) making up the data electrode driving circuit 42, each of gray scale voltage information storing sections $\mathbf{45}_R$, $\mathbf{45}_G$, and $\mathbf{45}_B$ (see FIG. 13) captures red gray scale voltage information $D_{R0}$ to $D_{R17}$ through channels Ch R0 to CH R17, green gray scale voltage information $D_{G0}$ to $D_{G17}$ through channels Ch G0 to Ch G17 and blue gray scale voltage information $D_{B0}$ to $D_{B17}$ through channels Ch B0 to Ch B17 which are all fed by using wirings prepared to supply 8 bits of parallel red data $D_R$, 8 bits of parallel green data $D_G$, and 8 bits of parallel blue data $D_B$ to be fed from the control circuit 41 (refer to FIG. 13, to be described later in detail).

The red gray scale voltage information $D_{R0}$ to $D_{R17}$, green gray scale voltage information $D_{G0}$ to $D_{G17}$, and blue gray scale voltage information $D_{B0}$ to $D_{B17}$ are signals used to provide an instruction as to which gray scale voltage should be selected out of 256 pieces of the gray scale voltages $V_0$ ($=V_{REF}/255\times0=0$[V]) to $V_{255}$ ($=V_{REF}/255\times255=V_{REF}$[V]) fed from a gray scale voltage supplying source 29 to an MPX 30 (see FIG. 13) in order to provide gray scales by making an individual and separate gamma correction to each of the red data $D_R$, green data $D_G$, and blue data $D_B$, in each of the data electrode driving sections $\mathbf{42}_1$ to $\mathbf{42}_K$ making up the data electrode driving circuit 42. A voltage $V_{REF}$ is a reference voltage. FIGS. 11A, 11B, and 11C show one example of relations between each of bits D7 to D0 of the red gray scale voltage information $D_{R0}$ to $D_{R17}$, green gray scale voltage information $D_{G0}$ to $D_{G17}$, and blue gray scale voltage information $D_{B0}$ to $D_{B17}$ and each of the gray scale voltages $V_0$ to $V_{255}$. In the embodiment, the counted number of the clocks CLK corresponds to any one of the channel Ch R0 to CH R17, Ch G0 to Ch G17, and Ch B0 to Ch B17 each of which also corresponds to the red data $D_R$, the green data $D_G$, and the blue data $D_B$ to which the individual and separate gamma correction is made in order to provide gray scales. That is, the counted number of the clocks CLK fed while the chip selection signal CS remains high (see (1) in FIG. 15) corresponds, in a one-to-one relationship, to each of the red gray scale voltage information $D_{R0}$ to $D_{R17}$, the green gray scale voltage information $D_{G0}$ to $D_{G17}$, and the blue gray scale voltage information $D_{B0}$ to $D_{B17}$ (see (2) to (4) in FIG. 15). For example, each of the red gray scale voltage information $D_{R0}$, the green gray scale voltage information $D_{G0}$, and the blue gray scale voltage information $D_{B0}$ fed when the counted number of the clocks CLK is 0 (zero) corresponds to each of the channels Ch R0, Ch G0, and Ch B0. Moreover, the gamma correction employed in the second embodiment also includes the first gamma correction and the second gamma correction described above.

The data electrode driving circuit 42 shown in FIG. 10 is made up of k pieces of the data electrode driving sections $\mathbf{42}_1$ to $\mathbf{42}_K$ (not shown). Each of the data electrode driving sections $\mathbf{42}_1$ to $\mathbf{42}_K$ makes the gamma correction to the red data $D_R$, green data $D_G$, and blue data $D_B$, out of the red data $D_R$, green data $D_G$, and blue data $D_B$ fed from the control circuit 41, each corresponding to each of the data electrodes in the color liquid crystal display 1 in order to provide gray scales and converts the red data $D_R$, green data $D_G$, and blue data $D_B$ into 384 pieces of analog data signals $S_1$ to $S_{384}$ and then outputs them. For example, if the color liquid crystal display 1 is of the SXGA-type, the data electrode driving circuit 42 is made up of 10 pieces of the data electrode driving sections $\mathbf{42}_1$ to $\mathbf{42}_{10}$. Since all of the data electrode driving sections $\mathbf{42}_1$ to $\mathbf{42}_{10}$ have the same configurations except that each of their components and each of input and output signals have a different subscript, a description of only the data electrode driving section $\mathbf{42}_1$ will be provided below.

Figure 12:
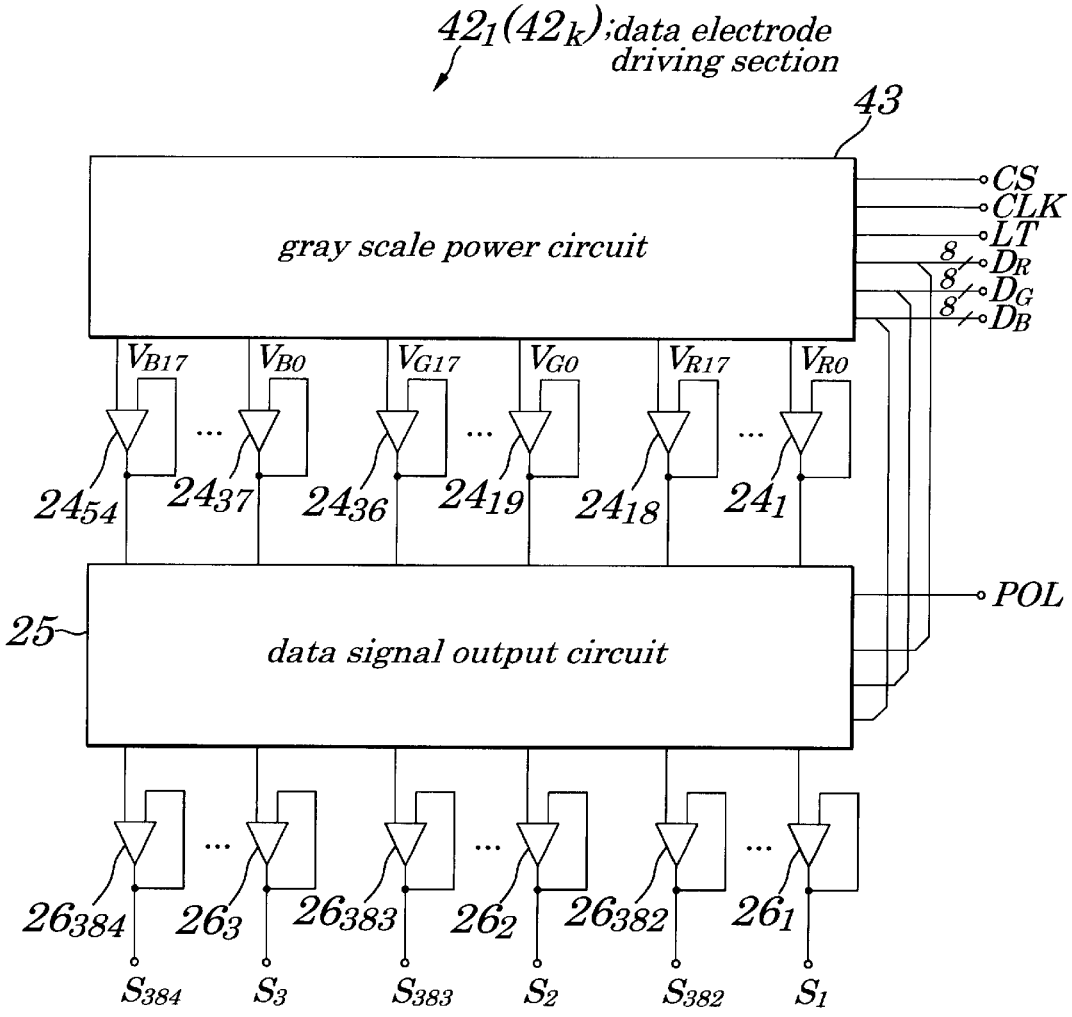
FIG. 12 is a schematic block diagram showing configurations of a data electrode driving section $\mathbf{42}_1$ being part of a data electrode driving circuit 42 making up the driving circuit of the color liquid crystal display according to the second embodiment of the present invention.

FIG. 12 is a schematic block diagram showing configurations of a data electrode driving section $\mathbf{42}_1$ according to the second embodiment of the present invention. In FIG. 12, same reference numbers are assigned to corresponding parts in FIG. 4 and their descriptions are omitted accordingly. In the data electrode driving section $\mathbf{42}_1$, instead of a gray scale power circuit 23 shown in FIG. 4, a gray scale power circuit 43 is mounted.

Figure 13:
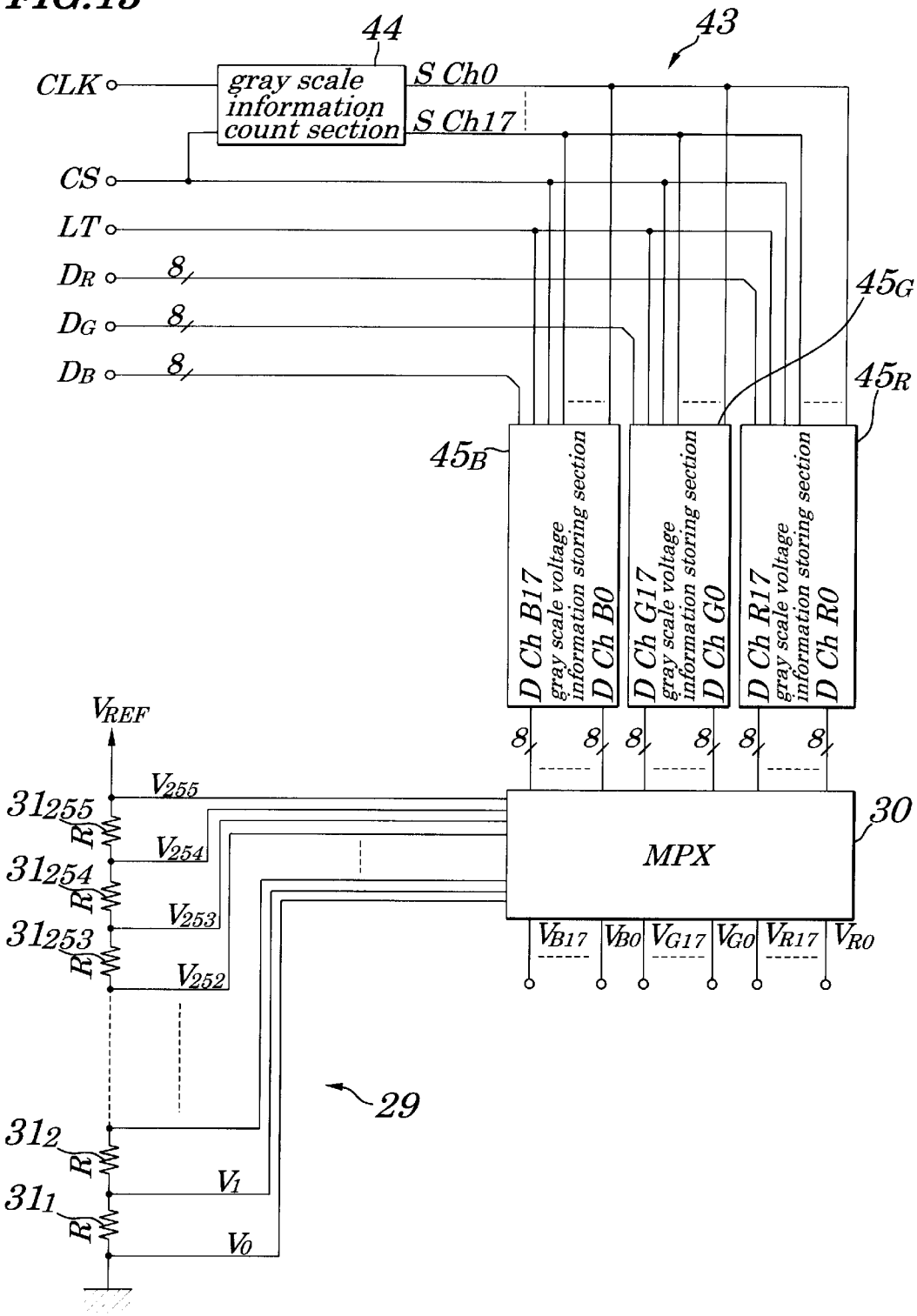
FIG. 13 is a schematic block diagram showing configurations of a gray scale power circuit 43 making up the data electrode driving section $\mathbf{42}_1$ according to the second embodiment of the present invention.

FIG. 13 is a schematic block diagram showing configurations of the gray scale power circuit 43. In FIG. 13, same reference numbers are assigned to corresponding parts in FIG. 5 and their descriptions are omitted. In FIG. 13, instead of a shift register 27 and a gray scale voltage information storing section 28 shown in FIG. 5, a gray scale information count section 44 and gray scale voltage information storing sections $\mathbf{45}_R$, $\mathbf{45}_G$, and $\mathbf{45}_B$ are newly mounted.

The gray scale information count section 44 counts the number of the clocks CLK being fed while the chip selection signal CS is high and then outputs sequentially high-level selection information S Ch0 to S Ch17 to provide an instruction as to which channel out of the channels D Ch R0 to D Ch R17, D Ch G0 to D Ch G17, and D Ch B0 to D Ch B17 should be selected, based on the resulting number of the clocks CLK. The gray scale voltage information storing sections $45_R$, $45_G$, $45_B$ are made up of semiconductor memories such as non-volatile semiconductor memories including ROMs, RAMs, flash EEPROMs, or a like and each of 8 bits of selection signals D Ch R0 to D Ch R17, D Ch G0 to D Ch G17, and D Ch B0 to D Ch B17 is stored in each of its channels Ch R0 to Ch R17, Ch G0 to Ch G0 to Ch G17, and Ch B0 to Ch B17. The gray scale voltage information storing sections $45_R$, $45_G$, $45_B$ capture the red gray scale voltage information $D_{R0}$ to $D_{R17}$, green gray scale voltage information $D_{G0}$ to $D_{G17}$, and blue gray scale voltage information $D_{B0}$ to $D_{B17}$, with timing when the latch signal LT fed from the control circuit 41 goes "high", and output any one of 8 bits of the selection signals D Ch R0 to D Ch R17, D Ch G0 to D Ch G17, and D Ch B0 to D Ch B17 selected based on the red gray scale voltage information $D_{R0}$ to $D_{R17}$, green gray scale voltage information $D_{G0}$ to $D_{G17}$ and blue gray scale voltage information $D_{B0}$ to $D_{B17}$ from the channel selected based on the "high-level" selection information S Ch 0 to S Ch 17 fed from the gray scale information count section 44 and then feed them to the MPX 30.

In the display device provided with the driving circuit of the color liquid crystal display 1 having configurations of the present invention described above, if the configurations are explained by referring to FIG. 20, only the control circuit 41 is mounted on the printed circuit board 16 while the data electrode driving sections $42_1$ to $42_{10}$ are mounted on ten pieces of film carrier tapes electrically connecting the printed circuit board 16 to the color liquid crystal display 1, that is, they are packaged in the form of TCPs (Tape Carrier Packages) $17_1$ to $17_{10}$ and the printed circuit board 16, as shown in FIG. 21, is attached to an upper portion of a rear of the backlight 18 (see FIG. 21) being wedge-shaped in cross section which has been mounted on a rear of the color liquid crystal display 1.

Next, operations of the control circuit 41 and data electrode driving circuit 42 being characteristic portions of the present invention, out of operations of the driving circuit of the color liquid crystal display 1 having configurations described above will be explained by referring to FIGS. 14 and 15.

Figure 14:
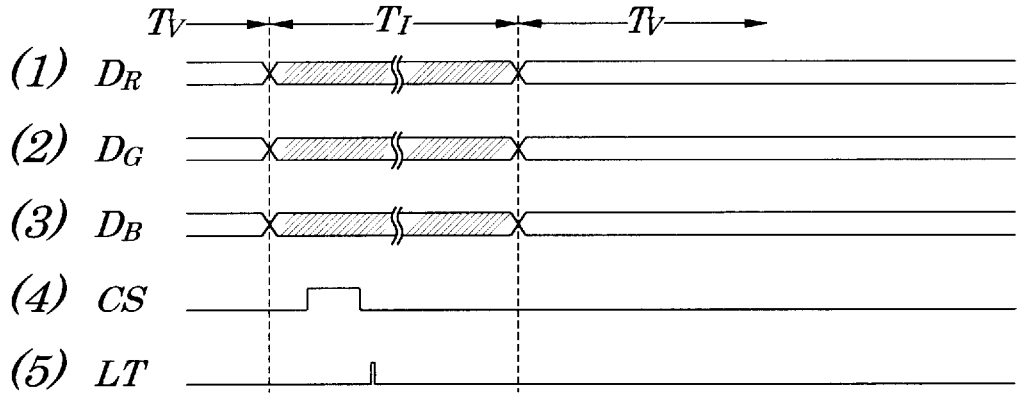
FIG. 14 is a timing chart explaining one example of operations of the driving circuit according to the second embodiment of the present invention.
Figure 15:
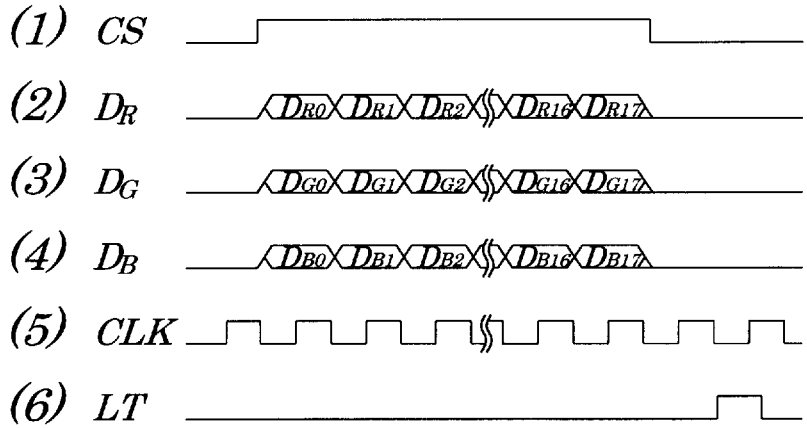
FIG. 15 is also a timing chart explaining one example of operations of the driving circuit according to the second embodiment of the present invention.

The control circuit 41, during an invalid period $T_I$ being a period having no bearing on the image displaying period such as an vertical retrace interval or horizontal retrace interval of color video signals or a like after power has been applied to the display device provided with the driving circuit of the color liquid crystal display 1 of the embodiment, feeds the chip selection signal CS, latch signal LT, and clock CLK by using their exclusive wirings and the red gray scale voltage information $D_{R0}$ to $D_{R17}$, green gray scale voltage information $D_{G0}$ to $D_{G17}$ and blue gray scale voltage information $D_{B0}$ to $D_{B17}$ by using wirings used to feed the red data $D_R$, green data $D_G$, and blue data $D_B$, with timing shown by (4) and (5) in FIG. 14, more particularly, with timing shown by (1) to (6) in FIG. 15.

That is, the control circuit 41, during the "invalid" period $T_I$, makes the chip selection signal CS go "high" for a predetermined period. Also, during the above period, the control circuit 41, after having fed the 8 bits of the red gray scale voltage information $D_{R0}$ to $D_{R17}$, 8 bits of the green gray scale voltage information $D_{G0}$ to $D_{G17}$, and 8 bits of the blue gray scale voltage information $D_{B0}$ to $D_{B17}$ shown by (2) to (4) in FIG. 15 used to provide an instruction as to which voltage should be selected out of the 256 pieces of the gray scale voltages $V_0$ to $V_{255}$ (see FIG. 11), to the data electrode driving circuit 42, supplies the latch signal LT shown by (6) in FIG. 15 in synchronization with the clock CLK shown by (5) in FIG. 15.

In the data electrode driving sections $42_1$ to $42_{10}$ making up the data electrode driving circuit 42, the gray scale information count section 44 making up the gray scale power circuit 43 counts the number of the clocks CLK fed while the chip selection signal CS remains "high" and sequentially outputs "high-level" selection signals S Ch0 to S Ch17. Then, the gray scale voltage information storing sections $45_R$, $45_G$, $45_B$ capture the 8 bits of red gray scale voltage information $D_{R0}$ to $D_{R17}$, 8 bits of green gray scale voltage information $D_{G0}$ to $D_{G17}$, and 8 bits of blue gray scale voltage information $D_{B0}$ to $D_{B17}$, with timing when the latch signal LT fed from the control circuit 41 goes "high" (see (6) in FIG. 15), and output any one of the 8 bits of the selection signals D Ch R0 to D Ch R17, D Ch G0 to D Ch G17, and D Ch B0 to D Ch B17 selected based on the red gray scale voltage information $D_{R0}$ to $D_{R17}$, green gray scale voltage information $D_{G0}$ to $D_{G17}$, and blue gray scale voltage information $D_{BO}$ to $D_{B17}$ from the channel selected based on the high-level selection information S Ch0 to S Ch17 fed from the gray scale information count section 44 and then feeds them to the MPX 30.

Next, since the MPX 30 selects any one of the 256 pieces of gray scale voltages $V_0$ to $V_{255}$ fed from the gray scale voltage supplying source 29 based on 8 bits of selection signals D Ch R0 to D Ch R17, D Ch G0 to D Ch G17, and D Ch B0 to D Ch B17 fed from the gray scale voltage information storing section 28 and outputs them as analog red gray scale voltages $V_{R0}$ to $V_{R17}$ analog green gray scale voltages $V_{G0}$ to $V_{G17}$, and analog blue gray scale voltages $V_{B0}$ to $V_{B17}$, the voltage followers $24_1$ to $24_{54}$ feeds corresponding red gray scale voltages $V_{R0}$ to $V_{R17}$, green gray scale voltages $V_{G0}$ to $V_{G17}$, and blue gray scale voltages $V_{B0}$ to $V_{B17}$, as they are, to the data signal output circuit 25.

In each of the data signal output sections $25_R$, $25_G$, and $25_B$ making up the data signal output circuit 25, each of the gray scale voltage splitting sections $32_R$, $32_G$, and $32_B$ splits each of the red gray scale voltages $V_{R0}$ to $V_{R17}$, the green gray scale voltages $V_{G0}$ to $V_{G17}$, and the green gray scale voltages $V_{G0}$ to $V_{G17}$ fed from the voltage followers $24_1$ to $24_{54}$ into 256 pieces of the red gray scale voltages $V_{GR0}$ to $V_{GR255}$, the green gray scale voltages $V_{GG0}$ to $V_{GG255}$ the blue gray scale voltages $V_{GB0}$ to $V_{GB255}$ and feeds them to the MPX $33_R$, MPX $33_G$, and MPX $33_B$.

By the above-described operations repeated once, the red gray scale voltages $V_{GR0}$ to $V_{GR255}$, green gray scale voltages $V_{GG0}$ to $V_{GG255}$, and blue gray scale voltages $V_{GB0}$ to $V_{GB255}$ to which considerations have been given in order to make the most of luminance in the minimum to the maximum range of V–T (applied voltage–transmittance) characteristics corresponding to the red, green, and blue colors for the color liquid crystal display 1, are set to the MPX $33_R$, MPX $33_G$, and MPX $33_B$.

Moreover, operations thereafter are the same as those in the first embodiment and therefore their operations are omitted.

Thus, according to the configurations of the embodiment, since the gray scale power circuit 43 is mounted inside the data electrode driving sections $42_1$ to $42_{10}$ when the wirings are formed on the surface layer of the printed circuit board 16 according to the conventional first method described above, the required number of the wirings is only two, each of which is used to transmit the chip selection signal CS and latch signal LT and, as a result, it is possible to reduce 52 pieces of wirings and to prevent the length of the depth $D_P$ of the printed circuit board 16 (see FIG. 20) from becoming large and the area (see FIG. 20) required for the printed circuit board 16 to be mounted on the upper portion of the rear of the backlight 18 (see FIG. 21) from becoming large. Therefore, even if the type of the color liquid crystal display 1, that is, its resolution is different, the backlight 18 being commonly applicable to any type of the color liquid crystal display 1 can be used and no increase in costs of the display device occurs. Moreover, since the width $W_T$ (see FIG. 20) of the TCP $\mathbf{17}_1$ to $\mathbf{17}_{10}$ does not become larger, it is possible to easily mount ten pieces of the TCP $\mathbf{17}_1$ to $\mathbf{17}_{10}$ in the direction of the width $W_T$ of the TCP $\mathbf{17}_1$ to $\mathbf{17}_{10}$ (see FIG. 20).

On the other hand, even when the wirings are formed on the inner layer of the printed circuit board 16 according to the conventional second method described above, the required number of the wirings is only two. Therefore, even when the two wirings formed on the inner layer of the printed circuit board 16 are to be connected to two wirings connected to corresponding two terminals formed on the surface layer of the printed circuit board 16 through the through hole, it is not necessary to make large the area required for forming all through holes.

Moreover, according to the configurations of the embodiment, since the gray scale power circuit 43 is mounted inside the data electrode driving sections $\mathbf{42}_1$ to $\mathbf{42}_{10}$, even when the number of the gray scale voltages including the red gray scale voltages $V_{R0}$ to $V_{R17}$, green gray scale voltages $V_{G0}$ to $V_{G17}$, and blue gray scale voltages $V_{B0}$ to $V_{B17}$ is different, the area required for forming all the through holes, depth $D_P$ of the printed circuit board 16 and the width $W_T$ of each of the TCP $\mathbf{17}_1$ to $\mathbf{17}_{10}$ remain unchanged and, as a result, even if the type of the color liquid crystal display 1, that is, its resolution is different, the printed circuit board 16 and the TCP $\mathbf{17}_1$ to $\mathbf{17}_{10}$ being commonly applicable to any type of the color liquid crystal display 1 can be used, which can avoid the increase in costs of the printed circuit board 16 and the TCP $\mathbf{17}_1$ to $\mathbf{17}_{10}$ and therefore can prevent costs of the display device from being increased.

Thus, according to the second embodiment, the substrate packaging area can be reduced and even if the resolution of the liquid crystal display 1 and/or the number of the gray scale voltages are different, the common substrate and/or TCP can be used, which enables the substrate and/or TCP, that is, the display device to be manufactured at low costs.

Moreover, according to the second embodiment, since the red gray scale voltage information $D_{R0}$ to $D_{R17}$, green gray scale voltage information $D_{G0}$ to $D_{G17}$, and blue gray scale voltage information $D_{B0}$ to $D_{B17}$ are fed by using the wirings used to supply the red data $D_R$, green data $D_G$, and blue data $D_B$ to the data electrode driving circuit 42, it is possible to reduce the number of the wirings more compared with the case in the first embodiment and to use the wirings effectively. Furthermore, since the red gray scale voltages $V_{GR0}$ to $V_{GR255}$, green gray scale voltages $V_{GG0}$ to $V_{GG255}$, and blue gray scale voltages $V_{GB0}$ to $V_{GB255}$ can be set, in one operation, to the MPX $\mathbf{33}_R$, MPX $\mathbf{33}_G$ and MPX $\mathbf{33}_B$, the processing is made simpler compared with the case in the first embodiment and the time required for the setting can be shortened.

It is needless to say that, as in the conventional case, it is possible to provide gray scales and to obtain an reproduced image having excellent gray scales by employing the optimum gamma corrections. Moreover, the driving circuit of the present invention can be used in the color liquid crystal display 1 having even the high V–T characteristics.

Furthermore, even when the collapse of the gray scale in any specified color out of the red, green, and blue colors occurs, the collapse can be recovered by changed gray scale information and changed gray scale voltages, which are fed by the control circuit 41 to the data electrode driving circuit 42, adapted to change the gray scale voltages (any one of the voltages $V_{R0}$ to $V_{R17}$, $V_{G0}$ to $V_{G17}$ and $V_{B0}$ to $V_{B17}$) corresponding to a region of the color in which the collapse of the gray scale has occurred (any one of an area near a white level, area near gray level, and area near black level).

Figure 16:
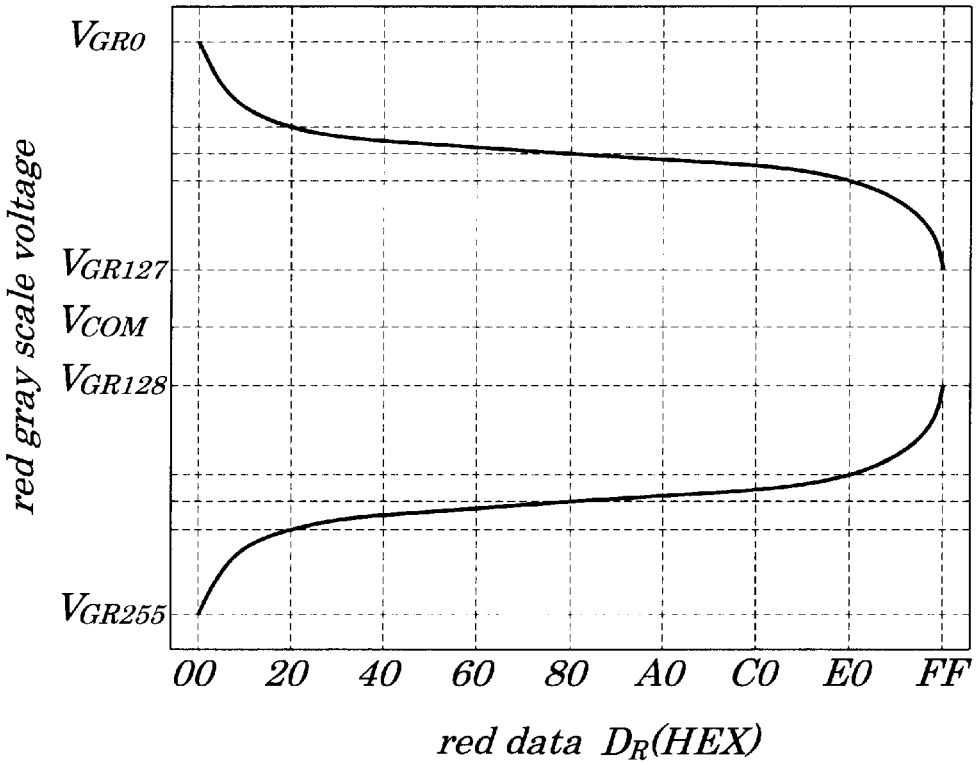
FIG. 16 is a diagram showing one example of a relation between 8 bits of red data $D_R$ to be fed to a data signal output section $\mathbf{25}_R$ being part of a data electrode driving circuit 22 making up a driving circuit of a color liquid crystal display being a modified example of the present invention and red gray scale voltages $V_{GR0}$ to $V_{GR127}$ and $V_{GR128}$ to $V_{GR255}$.

It is apparent that the present invention is not limited to the above embodiments but may be changed and modified without departing from the scope and spirit of the invention. For example, in the above embodiments, the driving circuit of the present invention is applied to the normally-black type liquid crystal display, however, it may be applied to a normally-white type liquid crystal display in which transmittance or luminance of light obtained when an off-driving voltage is applied is higher than that obtained when the on-driving voltage is applied. In this case, for example, in the above embodiments, the relation between the 8 bits of red data $D_R$ to be fed to the data signal output section $\mathbf{25}_R$ and the red gray scale voltages $V_{GR0}$ to $V_{GR127}$ and $V_{GR128}$ to $V_{GR255}$ is shown not in FIG. 7, but in FIG. 16.

Also, in the above embodiments, the present invention is applied to the active-matrix type color liquid crystal display 1 using the TFT as the switching element, however, the present invention may be applied to the color liquid crystal display having any configuration and/or function.

Also, in the above embodiments, the first gamma correction represents the gamma correction which is made in order to arbitrarily provide a characteristic of luminance required in the reproduced image to the luminance of input images and, as an example of the gamma correction, a gamma correction matched with a gamma characteristic (gamma is 2.2) of a CRT display is included, however, a gamma correction that is matched with the gamma characteristic being different from that of the CRT may be used. For example, when various products are sold through a TV broadcast and/or the Internet, in order to achieve excellent matching between colors of actual products and those displayed by the color liquid crystal display, the first gamma correction may be employed.

Also, in the above embodiments, the first and second gamma corrections are used, however, only the second gamma correction may be used.

Also, in the above embodiment, the driving circuit of the present invention is used in the processing of digital video data, however, it may be employed in processing of analog digital video data.

Also, in the gray scale power circuit 23 of the above first embodiment, the decoder is mounted inside the gray scale voltage information storing section 28, however, the decoder may be mounted outside the gray scale voltage information storing section 28.

Furthermore, the driving circuit of the color liquid crystal display 1 of the present invention may be used in a display device provided with a color liquid crystal display serving as a monitor for personal computers.

What is claimed is:

1. A driving circuit of a color liquid crystal display comprising:

a data electrode driving circuit to drive said color liquid crystal display by using a gray scale voltage selected based on a video signal out of a plurality of gray scale voltages;

wherein said data electrode driving circuit produces a plurality of said gray scale voltages corresponding to a gray scale voltage characteristic based on digital gray scale voltage setting data to be supplied;

wherein said control circuit is mounted on a printed circuit board attached to an upper portion of a rear of a backlight placed on a rear of said color liquid crystal display and wherein said data electrode driving circuit includes a plurality of data electrode driving sections to provide gray scales by making said gamma correction to said red data, said green data, and said blue data each being corresponding to each of data electrodes of said color liquid crystal display, out of said red data, said green data, and said blue data and converts said gamma-corrected red data, said gamma-corrected green data, and said gamma-corrected blue data into an analog data red signal, an analog data green signal, and an analog data blue signal, such that said analog data red signal, said analog data green signal, and said analog data blue signal are output; and wherein each of said plurality of said data electrode driving sections is mounted on a corresponding film carrier tape connecting said printed circuit board to said color liquid crystal display.

2. A driving circuit of a color liquid crystal display for driving said color liquid crystal display by using a data red signal, a data green signal, and a data blue signal obtained by making an individual gamma correction to red data, green data, and blue data being digital video data in order to make corrections so that each of said red data, said green data, and said blue data matches a transmittance characteristic of each of a red color, a green color, and a blue color for a voltage applied in said color liquid crystal display, said driving circuit comprising:

a control circuit mounted separately from said color liquid crystal display and to output, during an invalid period having no bearing on a displaying period for said digital video data, information about said gamma correction to be made to said red data, said green data, and said blue data; and a data electrode driving circuit mounted in a vicinity of said color liquid crystal display and to drive said color liquid crystal display by using said data red signal, said data green signal, and said data blue signal obtained by making said gamma correction to said red data, said green data, and said blue data, based on information about said gamma correction to be made to said red data, said green data, and said blue data;

wherein said control circuit is mounted on a printed circuit board attached to an upper portion of a rear of a backlight placed on a rear of said color liquid crystal display and wherein said data electrode driving circuit includes a plurality of data electrode driving sections to provide gray scales by making said gamma correction to said red data, said green data, and said blue data each being corresponding to each of data electrodes of said color liquid crystal display, out of said red data, said green data, and said blue data and converts said gamma-corrected red data, said gamma-corrected green data, and said gamma-corrected blue data into an analog data red signal, an analog data green signal, and an analog data blue signal, such that said analog data red signal said analog data green signal, and said analog data blue signal are output; and wherein each of said plurality of said data electrode driving sections is mounted on a corresponding film carrier tape connecting said printed circuit board to said color liquid crystal display.

3. The driving circuit of the color liquid crystal display according to claim 2, wherein said information about said gamma correction to be made to said red data, said green data, and said blue data, is made up of gray scale information to provide an instruction as to which gray scale voltage should be selected out of said gray scale voltages for said red data, said green data, and said blue data, and of gray scale voltage information to provide an instruction as to which gray scale voltage should be selected out of said plurality of said gray scale voltages.

4. The driving circuit of the color liquid crystal display according to claim 3, wherein said control circuit feeds said gray scale information and said gray scale voltage information to said data electrode driving circuit as serial data.

5. The driving circuit of the color liquid crystal display according to claim 3, wherein said control circuit feeds said gray scale voltage information by using wirings prepared to supply said red data, said green data, and said blue data to said data electrode driving circuit.

6. The driving circuit of the liquid crystal display according to claim 2, wherein each of said data electrode driving sections includes:

a shift register to convert said serial data into parallel gray scale information and parallel gray scale voltage information, such that said parallel gray scale information and said parallel gray scale voltage information;

a storing section to store, in advance, a selection signal to provide an instruction as to which gray scale voltage should be selected as a plurality of gray scale voltages for said red data, said green data, and said blue data;

a decoder to decode said gray scale information and to output selection information to provide an instruction as to which gray scale voltage should be selected out of said plurality of said gray scale voltages for said red data, said green data, and said blue data;

a multiplexer to select any one of said gray scale voltage based on said selection signal read from said storing section according to said selection information and to output said selected gray scale voltage as a plurality of red gray scale voltages, green gray scale voltages, and blue gray scale voltages; and a data signal output section to provide gray scales by making said gamma correction to said red data, said green data, and said blue data, based on said plurality of said red gray scale voltages, said green gray scale voltages, and said blue gray scale voltages and to convert said gamma-corrected red data, said gamma-corrected green data, and said gamma-corrected blue data into an analog data red signal, an analog data green signal, and an analog data blue signal.

7. The driving circuit of the color liquid crystal display according to claim 2, wherein said gamma correction includes said gamma correction which is made in order to arbitrarily provide a characteristic of luminance required in reproduced images to luminance of input images.

8. A driving circuit of a color liquid crystal display for driving said color liquid crystal display by using a data red signal, a data green signal, and a data blue signal obtained by making an individual gamma correction to red data, green data, and blue data being digital video data in order to make corrections so that each of said red data, said green data, and said blue data matches a transmittance characteristic of each of a red color, a green color, and a blue color for a voltage applied in said color liquid crystal display, said driving circuit comprising:

a control circuit mounted separately from said color liquid crystal display and to output, during an invalid period having no bearing on a displaying period for said digital video data, information about said gamma correction to be made to said red data, said green data, and said blue data; and a data electrode driving circuit mounted in a vicinity of said color liquid crystal display and to drive said color liquid crystal display by using said data red signal, said data green signal, and said data blue signal obtained by making said gamma correction to said red data, said green data, and said blue data, based on information about said gamma correction to be made to said red data, said green data, and said blue data;

wherein said information about said gamma correction to be made to said red data, said green data, and said blue data, is made up of gray scale information to provide an instruction as to which gray scale voltage should be selected out of said gray scale voltages for said red data, said green data, and said blue data, and of gray scale voltage information to provide an instruction as to which gray scale voltage should be selected out of said plurality of said gray scale voltages; and wherein a number of counts of clocks used to capture said red data, said green data, and said blue data in said data electrode driving circuit, is associated, in a one-to-one relationship, with an order in which said gray scale voltage information about said red data, said green data, and said blue data is fed to said data electrode driving circuit and wherein said number of counts of clocks is used as said gray scale information.

9. The driving circuit of the color liquid crystal display according to claim 8, wherein each of said data electrode driving sections includes:

a red gray scale voltage information storing section to store, in advance, a selection signal to provide an instruction as to which gray scale voltage should be selected as a plurality of said red gray scale voltages for said red data;

a green gray scale voltage information storing section to store, in advance, a selection signal to provide an instruction as to which gray scale voltage should be selected as a plurality of said green gray scale voltages for said green data;

a blue gray scale voltage information storing section to store, in advance, a selection signal to provide an instruction as to which gray scale voltage should be selected as a plurality of said blue gray scale voltages for said blue data;

a gray scale information count section to count a number of supplied clocks and to output selection information to provide an instruction as to which gray scale voltage should be selected out of a plurality of said gray scale voltages according to said number of counts of said clocks;

a multiplexer to select any one of gray scale voltages based on said selection signal read from said red gray scale information storing section, said green gray scale information storing section, and said blue gray scale information storing section according to said selection information and to output said selected gray scale voltage as a plurality of red gray scale voltages, a plurality of green gray scale voltages, and a plurality of blue gray scale voltages; and a data signal output section to provide gray scales by making said gamma correction to said red data, said green data, and said blue data based on said plurality of said red gray scale voltages, said green gray scale voltages, and said blue gray scale voltages and to convert said gamma-corrected red data, said gamma-corrected green data, and said gamma-corrected blue data into an analog data red signal, an analog data green signal, and an analog data blue signal, such that said analog data red signal, said analog data green signal, and said analog data blue signal are output.

10. A display device provided with a driving circuit of a color liquid crystal display comprising:

a data electrode driving circuit to drive said color liquid crystal display by using a gray scale voltage selected based on a video signal out of a plurality of gray scale voltages; and wherein said data electrode driving circuit produces a plurality of said gray scale voltages corresponding to a gray scale voltage characteristic based on digital gray scale voltage setting data to be supplied;

wherein said control circuit is mounted on a printed circuit board attached to an upper portion of a rear of a backlight placed on a rear of said color liquid crystal display and wherein said data electrode driving circuit includes a plurality of data electrode driving sections to provide gray scales by making said gamma correction to said red data, said green data, and said blue data each being corresponding to each of data electrodes of said color liquid crystal display, out of said red data, said green data, and said blue data and converts said gamma-corrected red data, said gamma-corrected green data, and said gamma-corrected blue data into an analog data red signal, an analog data green signal, and an analog data blue signal, such that said analog data red signal, said analog data green signal, and said analog data blue signal are output; and wherein each of said plurality of said data electrode driving sections is mounted on a corresponding film carrier tape connecting said printed circuit board to said color liquid crystal display.

11. A display device provided with a driving circuit of a color liquid crystal display for driving said color liquid crystal display by using a data red signal, a data green signal, and a data blue signal obtained by making an individual gamma correction to red data, green data, and blue data being digital video data in order to make corrections so that each of said red data, said green data, and said blue data matches a transmittance characteristic of each of a red color, a green color, and a blue color for a voltage applied in said color liquid crystal display, said driving circuit comprising:

a control circuit mounted separately from said color liquid crystal display and to output, during an invalid period having no bearing on a displaying period for said digital video data, information about said gamma correction to be made to said red data, said green data, and said blue data; and a data electrode driving circuit mounted in a vicinity of said color liquid crystal display and to drive said color liquid crystal display by using said data red signal, said data green signal, and said data blue signal obtained by making said gamma correction to said red data, said green data, and said blue data, based on information about said gamma correction to be made to said red data, said green data, and said blue data;

wherein said control circuit is mounted on a printed circuit board attached to an upper portion of a rear of a backlight placed on a rear of said color liquid crystal display and wherein said data electrode driving circuit includes a plurality of data electrode driving sections to provide gray scales by making said gamma correction to said red data, said green data, and said blue data each being corresponding to each of data electrodes of said color liquid crystal display, out of said red data, said green data, and said blue data and converts said gamma-corrected red data, said gamma-corrected green data, and said gamma-corrected blue data into an analog data red signal, an analog data green signal, and an analog data blue signal, such that said analog data red signal, said analog data green signal, and said analog data blue signal are output; and wherein each of said plurality of said data electrode driving sections is mounted on a corresponding film carrier tape connecting said printed circuit board to said color liquid crystal display.

12. A method for driving a color liquid crystal display by using a data red signal, a data green signal, and a data blue signal obtained by making an individual gamma correction to red data, green data, and blue data being digital video data in order to make corrections so that each of said red data, said green data and said blue data matches a transmittance characteristic of each of red, green, and blue colors for a voltage applied in said color liquid crystal display, said method comprising:

a step of feeding, from a control circuit mounted separately from said color liquid crystal display, during an invalid period having no bearing on a displaying period for said digital video data, information about said gamma correction to be made to said red data, said green data, and said blue data, to a data electrode driving circuit mounted in a vicinity of said color liquid crystal display and to drive said color liquid crystal display by using the data red signal, the data green signal, and the data blue signal obtained by making said gamma correction to said red data, said green data, and said blue data, based on information about said gamma correction to be made to said red data, said green data, and said blue data;

wherein said control circuit is mounted on a printed circuit board attached to an upper portion of a rear of a backlight placed on a rear of said color liquid crystal display and wherein said data electrode driving circuit includes a plurality of data electrode driving sections to provide gray scales by making said gamma correction to said red data, said green data, and said blue data each being corresponding to each of data electrodes of said color liquid crystal display, out of said red data, said green data, and said blue data and converts said gamma-corrected red data, said gamma-corrected green data, and said gamma-corrected blue data into an analog data red signal, an analog data green signal, and an analog data blue signal, such that said analog data red signal, said analog data green signal, and said analog data blue signal are output; and wherein each of said plurality of said data electrode driving sections is mounted on a corresponding film carrier tape connecting said printed circuit board to said color liquid crystal display.

* * * * *